US011486374B2

(12) United States Patent
Murakoshi

(10) Patent No.: US 11,486,374 B2
(45) Date of Patent: Nov. 1, 2022

(54) NON-PULSATING PUMP AND METHOD OF CONTROLLING THE SAME

(71) Applicant: NIKKISO CO., LTD., Tokyo (JP)

(72) Inventor: Fusao Murakoshi, Higashimurayama (JP)

(73) Assignee: NIKKISO CO., LTD., Tokyo (JP)

( * ) Notice: Subject to any disclaimer, the term of this patent is extended or adjusted under 35 U.S.C. 154(b) by 60 days.

(21) Appl. No.: 16/981,222

(22) PCT Filed: Mar. 11, 2019

(86) PCT No.: PCT/JP2019/009665
§ 371 (c)(1),
(2) Date: Sep. 15, 2020

(87) PCT Pub. No.: WO2019/188184
PCT Pub. Date: Oct. 3, 2019

(65) Prior Publication Data

US 2021/0025375 A1 Jan. 28, 2021

(30) Foreign Application Priority Data

Mar. 28, 2018 (JP) ..... JP2018-061702

(51) Int. Cl.
*F04B 11/00* (2006.01)
*F04B 43/02* (2006.01)
(Continued)

(52) U.S. Cl.
CPC ..... *F04B 11/005* (2013.01); *F04B 13/00* (2013.01); *F04B 43/026* (2013.01);
(Continued)

(58) Field of Classification Search
CPC ..... F04B 9/02; F04B 11/00; F04B 11/005; F04B 13/00; F04B 43/026; F04B 43/067;
(Continued)

(56) References Cited

U.S. PATENT DOCUMENTS 1,927,587 A * 9/1933 Hacker ..... F04B 43/0054 235/3
3,809,507 A * 5/1974 Baglai ..... F04B 43/08 417/259
(Continued)

FOREIGN PATENT DOCUMENTS

CN 101382108 A 3/2009
GB 1480002 A 7/1977
(Continued)

OTHER PUBLICATIONS

Jun. 11, 2019 International Search Report issued in International Patent Application No. PCT/JP2019/009665.
(Continued)

*Primary Examiner* — Charles G Freay
(74) *Attorney, Agent, or Firm* — Oliff PLC

(57) ABSTRACT

When a pipe pressure of a common discharge pipe during an independent discharge step in which only one reciprocating pump among a plurality of reciprocating pumps discharges a fluid to the common discharge pipe differs from internal pressures in pump chambers of the respective reciprocating pumps at discharge step start point angles, a stroke adjustment mechanism adjusts, on the basis of a pressure difference ΔP therebetween, effective stroke lengths of cross heads connected to plungers of the predetermined reciprocating pumps so that the internal pressures in the pump chambers reach the pipe pressure at the discharge step start point angles.

6 Claims, 23 Drawing Sheets

(51) Int. Cl.

| | |
|---|---|
| ***F04B 13/00*** | (2006.01) |
| ***F04B 49/12*** | (2006.01) |
| ***F04B 43/067*** | (2006.01) |
| *F04B 9/02* | (2006.01) |

(52) U.S. Cl.
CPC ..... *F04B 43/067* (2013.01); *F04B 49/12* (2013.01); *F04B 9/02* (2013.01)

(58) Field of Classification Search
CPC ..... F04B 49/12; F04B 2201/0206; F04B 2203/0903
See application file for complete search history.

(56) References Cited

U.S. PATENT DOCUMENTS

| | | | | |
|---|---|---|---|---|
| 4,003,679 | A * | 1/1977 | McManigill | F04B 1/06 417/388 |
| 4,171,191 | A * | 10/1979 | Krueger | F04B 9/02 417/539 |
| 4,359,312 | A | 11/1982 | Funke et al. | |
| 4,540,346 | A * | 9/1985 | Davies | F04B 43/067 417/273 |
| 5,993,174 | A | 11/1999 | Konishi | |
| 6,923,916 | B1 | 8/2005 | Hiraku et al. | |
| 7,063,513 | B2 | 6/2006 | Hiraku et al. | |
| 10,890,166 | B2 * | 1/2021 | Murakoshi | F04B 11/005 |
| 2004/0164013 | A1 | 8/2004 | Takao et al. | |
| 2005/0095145 | A1 | 5/2005 | Hiraku et al. | |
| 2009/0068041 | A1 | 3/2009 | Beardmore | |
| 2013/0104631 | A1 | 5/2013 | Tokuo et al. | |
| 2018/0274531 | A1 | 9/2018 | Yanagibayashi | |
| 2019/0195208 | A1 | 6/2019 | Murakoshi et al. | |

FOREIGN PATENT DOCUMENTS

| | | | |
|---|---|---|---|
| JP | S51-122801 | A | 10/1976 |
| JP | S53-017762 | B2 | 6/1978 |
| JP | S59-70085 | U | 5/1984 |
| JP | S63-71586 | A | 3/1988 |
| JP | H03-026306 | Y2 | 6/1991 |
| JP | H04-072070 | B2 | 11/1992 |
| JP | H08-114177 | A | 5/1996 |
| JP | H09-264261 | A | 10/1997 |
| JP | 2004-044471 | A | 2/2004 |
| JP | 2004-108188 | A | 4/2004 |
| JP | 2004-137974 | A | 5/2004 |
| JP | 2004-150402 | A | 5/2004 |
| JP | 2004-232616 | A | 8/2004 |
| JP | 2006-52646 | A | 2/2006 |
| JP | 3861060 | B2 | 12/2006 |
| JP | 2007-327449 | A | 12/2007 |
| JP | 2010-101170 | A | 5/2010 |
| JP | 2012-032187 | A | 2/2012 |
| JP | 2013-007340 | A | 1/2013 |
| JP | 2013-029080 | A | 2/2013 |
| JP | 2013-032738 | A | 2/2013 |
| JP | 2018-035761 | A | 3/2018 |
| JP | 2018-040283 | A | 3/2018 |
| NO | 2018/042746 | A1 | 3/2018 |
| WO | 2017/090148 | A1 | 6/2017 |

OTHER PUBLICATIONS

Jun. 15, 2021 Office Action issued in Japanese Patent Application No. 2018-061702.
Dec. 27, 2021 Office Action and Search Report issued in Chinese Patent Application No. 201980019912.4.
Dec. 27, 2021 Opinion Notice issued in Chinese Patent Application No. 201980019912.4.
Nov. 11, 2021 Search Report issued in European Patent Application No. 19774824.7.
Dec. 7, 2021 Office Action issued in European Patent Application No. 19774824.7.
May 12, 2021 Search Report issued in European Patent Application No. 21167793.5.
Jun. 2, 2022 Office Action issued in Taiwanese Patent Application No. 108110040.

* cited by examiner

NON-PULSATING PUMP AND METHOD OF CONTROLLING THE SAME

CROSS REFERENCE TO RELATED APPLICATIONS

This application is a National Phase Application under 35 U.S.C. 371 of PCT Application No. PCT/JP2019/009665 having an international filing date of 11 Mar. 2019 which designated the United States, which PCT application claimed the benefit of Japanese Patent Application No. 2018-061702 filed 28 Mar. 2018, each of which are incorporated by reference in their entirely.

TECHNICAL FIELD

The present disclosure relates to a reciprocating pump, and in particular to a structure of a non-pulsating pump which is controlled such that a flow rate of discharge is constant.

BACKGROUND

In the related art, non-pulsating pumps are known which comprise two reciprocating pumps (duplex system) or three reciprocating pumps (triplex system). Such a non-pulsating pump comprises, for example, a common intake line and a common discharge line which are connected to each of the reciprocating pumps.

A reciprocating pump comprises a plunger which reciprocates, a pump chamber having a volume that is increased and decreased with forward and backward movements (reciprocating motion) of the plunger, and an intake valve and a discharge valve which are connected to the pump chamber. When the plunger moves backward (return motion), a pressure of the pump chamber is decreased, the intake valve is opened in response thereto, and liquid is introduced into the pump chamber. When the plunger moves past a bottom dead center and moves forward (forward motion), the pressure of the pump chamber is increased, and the discharge valve is opened. Liquid is sent through the opened discharge valve to the common discharge line.

As a driving device of each reciprocating pump, a motor, a cam shaft, and an eccentric drive cam are provided. The plunger of the reciprocating pump is connected to the eccentric drive cam, and the plunger is moved forward and backward according to rotation of the cam.

In the case of duplex system of a twin reciprocating pump, when a phase difference of the eccentric drive cam with respect to each reciprocating pump is 180°, a discharge step of one reciprocating pump and a discharge step of the other reciprocating pump are executed complementarily.

More specifically, as exemplified in FIG. 20, a sum of a flow rate Q1 of discharge from the one reciprocating pump and a flow rate Q2 of discharge from the other reciprocating pump is a line flow rate Q_L. With the complementary operation of the reciprocating pumps, a constant line flow rate Q_L1 can be obtained.

As exemplified in FIG. 21, between completion of an intake step of the reciprocating pump and start of the discharge step, a compression step is provided in which an inner pressure of the reciprocating pump is increased. In the compression step, the inside of the pump chamber is compressed until an inner pressure P_OR1 of the pump chamber of the reciprocating pump is equal to the line pressure P_L at the discharging side. When the inner pressure P_OR1 of the pump chamber and the line pressure P_L become equal to each other, the discharge valve separating the pump chamber and the common discharge line is set to an open state.

When the line pressure at the discharging side of the reciprocating pump changes, there may be cases where discharge is started within a period which is originally set as the compression step. For example, as exemplified at an upper part of FIG. 22, when the line pressure is a pressure P_L2 which is lower than a predetermined pressure P_L1, the inner pressure P_OR1 of the pump chamber becomes equal to the line pressure P_L2 at cam angles θ0 and θ3 before cam angles θ1 and θ4 which are set as completion points of the compression step, as shown by a narrow dotted line at a lower part, and the discharge is started at these cam angles. As a result, as shown by a solid line at the lower part, a pulsation is caused in which the line flow rate Q_L is rapidly increased from the constant flow rate Q_L1.

In consideration of this, for example, in Patent Literature 1, a pressure sensor or a flow rate sensor is provided on the common line, and an air release valve in communication with the pump chamber is also provided on the common line. When the pulsation is detected by the sensor, the pressure of the pump chamber is adjusted by the air release valve, so as to reduce the pulsation.

CITATION LIST

Patent Literature

Patent Literature 1: JP 3861060 B

SUMMARY

In the detection of the pulsation, in reality, a pulsation waveform does not take a shape as shown in FIG. 22. In FIG. 22, the pulsation has a sharp spike shape starting at the cam angles of θ0 and θ3 where the process switches from the intake step to the discharge step, but in reality, depending on a placement of the sensor, viscosity of the liquid, expansion of the line, or the like, the pulsation waveform has a gradual curved line shape rising from cam angles θ0 and θ3 and having peaks at cam angles of θ1 and θ4, as exemplified in FIG. 23. In this manner, the actually detected pulsation waveform has a low difference value (differentiation value) in comparison to the spike shape, and, as a consequence, pulsation detection precision may be reduced and pulsation suppression may become difficult.

An advantage of the present disclosure lies in provision of a non-pulsating pump which can suppress the pulsation with a higher precision than in the related art.

According to one aspect of the present disclosure, there is provided a non-pulsating pump. The non-pulsating pump comprises a drive mechanism, a plurality of reciprocating pumps, and a stroke adjustment mechanism. The drive mechanism comprises a cam mechanism and a plurality of crossheads. The cam mechanism converts a rotational motion of a drive motor into a reciprocating motion. The plurality of crossheads are reciprocated by the cam mechanism with a predetermined phase difference. Each of the plurality of reciprocating pumps comprises a plunger, a pump chamber, an intake valve, and a discharge valve. The plunger is connected to the crosshead, and reciprocates with the reciprocating motion of the crosshead. The pump chamber has an inner pressure which changes with the reciprocating motion of the plunger. The intake valve connects a common intake line and the pump chamber, and has a side of the pump chamber as a back pressure side. The discharge valve connects the pump chamber and a common discharge line, and has a side of the common discharge line as a back pressure side. The stroke adjustment mechanism adjusts an effective stroke length for the crosshead to reciprocate the plunger. When a line pressure of the common discharge line at a single discharge step in which only one reciprocating pump, among the plurality of reciprocating pumps, discharges fluid to the common discharge line differs from the inner pressure of the pump chamber of a predetermined reciprocating pump at a discharge step starting point angle determined corresponding to a cam angle of the cam mechanism with respect to the predetermined reciprocating pump, the stroke adjustment mechanism adjusts the effective stroke length of the crosshead connected to the plunger of the predetermined reciprocating pump based on the pressure difference such that the inner pressure of the pump chamber reaches the line pressure at the discharge step starting point angle.

According to another aspect of the present disclosure, the stroke adjustment mechanism may connect the plunger to the crosshead so as to enable a free reciprocating motion along a reciprocating motion direction of the crosshead. In this case, the effective stroke length of the crosshead is adjusted by adjusting a range of the free reciprocating motion.

According to another aspect of the present disclosure, the stroke adjustment mechanism may comprise a stopper which determines a range of the free reciprocating motion of the plunger, and an adjustment motor which moves the stopper forward and backward in the reciprocating motion direction of the crosshead. In this case, a forward/backward movement range of the stopper by the adjustment motor is determined based on a difference between the inner pressure of the pump chamber of the predetermined reciprocating pump at the discharge step starting point angle and the line pressure at the single discharge step.

According to another aspect of the present disclosure, a non-pulsating pump comprises a drive mechanism and a plurality of reciprocating pumps. The drive mechanism comprises a cam mechanism and a plurality of crossheads. The cam mechanism converts a rotational motion of a drive motor into a reciprocating motion. The plurality of crossheads are reciprocated by the cam mechanism with a predetermined phase difference. Each of the plurality of reciprocating pumps comprises a plunger, a pump chamber, an intake valve, a discharge valve, and an inner pressure adjustment mechanism. The plunger is connected to the crosshead, and reciprocates with the reciprocating motion of the crosshead. The pump chamber has an inner pressure which changes with the reciprocating motion of the plunger. The intake valve connects a common intake line and the pump chamber, and has a side of the pump chamber as a back pressure side. The discharge valve connects the pump chamber and a common discharge line, and has a side of the common discharge line as a back pressure side. The inner pressure adjustment mechanism can adjust the inner pressure of the pump chamber. When a line pressure of the common discharge line at a single discharge step in which only one reciprocating pump, among the plurality of reciprocating pumps, discharges fluid to the common discharge line differs from the inner pressure of the pump chamber of a predetermined reciprocating pump at a discharge step starting point angle determined corresponding to a cam angle of the cam mechanism with respect to the predetermined reciprocating pump, the inner pressure adjustment mechanism adjusts the inner pressure of the pump chamber of the predetermined reciprocating pump based on the pressure difference such that the inner pressure of the pump chamber reaches the line pressure at the discharge step starting point angle.

According to another aspect of the present disclosure, there is provided a method of controlling a non-pulsating pump. The non-pulsating pump comprises a drive mechanism, a plurality of reciprocating pumps, and a stroke adjustment mechanism. The drive mechanism comprises a cam mechanism and crossheads. The cam mechanism converts a rotational motion of a drive motor into a reciprocating motion. A plurality of crossheads are reciprocated by the cam mechanism with a predetermined phase difference. Each of the plurality of reciprocating pumps comprises a plunger, a pump chamber, an intake valve, and a discharge valve. The plunger is connected to the crosshead, and reciprocates with the reciprocating motion of the crosshead. The pump chamber has an inner pressure which changes with the reciprocating motion of the plunger. The intake valve connects a common intake line and the pump chamber, and has a side of the pump chamber as a back pressure side. The discharge valve connects the pump chamber and a common discharge line, and has a side of the common discharge line as a back pressure side. The stroke adjustment mechanism adjusts an effective stroke length for the crosshead to reciprocate the plunger. In the control method, when a line pressure of the common discharge line at a single discharge step in which only one reciprocating pump, among the plurality of reciprocating pumps, discharges fluid to the common discharge line differs from the inner pressure of the pump chamber of a predetermined reciprocating pump at a discharge step starting point angle determined corresponding to a cam angle of the cam mechanism with respect to the predetermined reciprocating pump, the effective stroke length of the crosshead connected to the plunger of the predetermined reciprocating pump is adjusted based on the pressure difference such that the inner pressure of the pump chamber reaches the line pressure at the discharge step starting point angle.

According to another aspect of the present disclosure, there is provided a method of controlling a non-pulsating pump, in which the non-pulsating pump comprises a drive mechanism and a plurality of reciprocating pumps. The drive mechanism comprises a cam mechanism and a plurality of crossheads. The cam mechanism converts a rotational motion of a drive motor into a reciprocating motion. The plurality of crossheads are reciprocated by the cam mechanism with a predetermined phase difference. Each of the plurality of reciprocating pumps comprises a plunger, a pump chamber, an intake valve, a discharge valve, and an inner pressure adjustment mechanism. The plunger is connected to the crosshead and reciprocates with the reciprocating motion of the crosshead. The pump chamber has an inner pressure which changes with the reciprocating motion of the plunger. The intake valve connects a common intake line and the pump chamber, and has a side of the pump chamber as a back pressure side. The discharge valve connects the pump chamber and a common discharge line, and has a side of the common discharge line as a back pressure side. The inner pressure adjustment mechanism can adjust the inner pressure of the pump chamber. In the control method, when a line pressure of the common discharge line at a single discharge step in which only one reciprocating pump, among the plurality of reciprocating pumps, discharges fluid to the common discharge line differs from the inner pressure of the pump chamber of a predetermined reciprocating pump at a discharge step starting point angle determined corresponding to a cam angle of the cam mechanism with respect to the predetermined reciprocating pump, the inner pressure of the pump chamber of the predetermined reciprocating pump is adjusted based on the pressure difference such that the inner pressure of the pump chamber reaches the line pressure at the discharge step starting point angle.

According to various aspects of the present disclosure, a non-pulsating pump can be provided in which pulsation can be suppressed with a higher precision than in the related art.

BRIEF DESCRIPTION OF DRAWINGS

Embodiment(s) of the present disclosure will be described based on the following figures, wherein.

DESCRIPTION OF EMBODIMENTS

<Structure of Non-Pulsating Pump>

Figure 1:
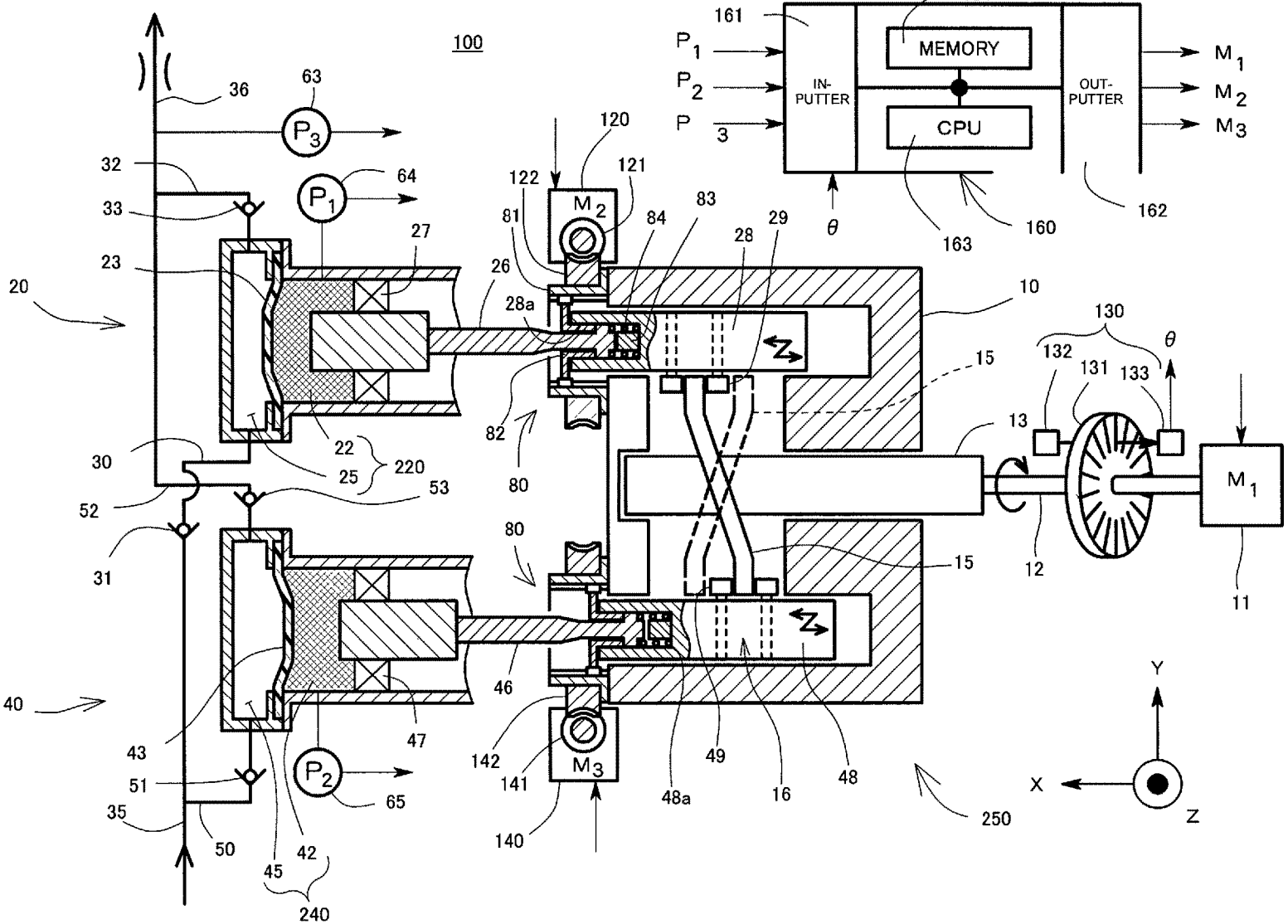
FIG. 1 is a cross sectional diagram showing a structure of a non-pulsating pump according to an embodiment of the present disclosure.
Figure 2:
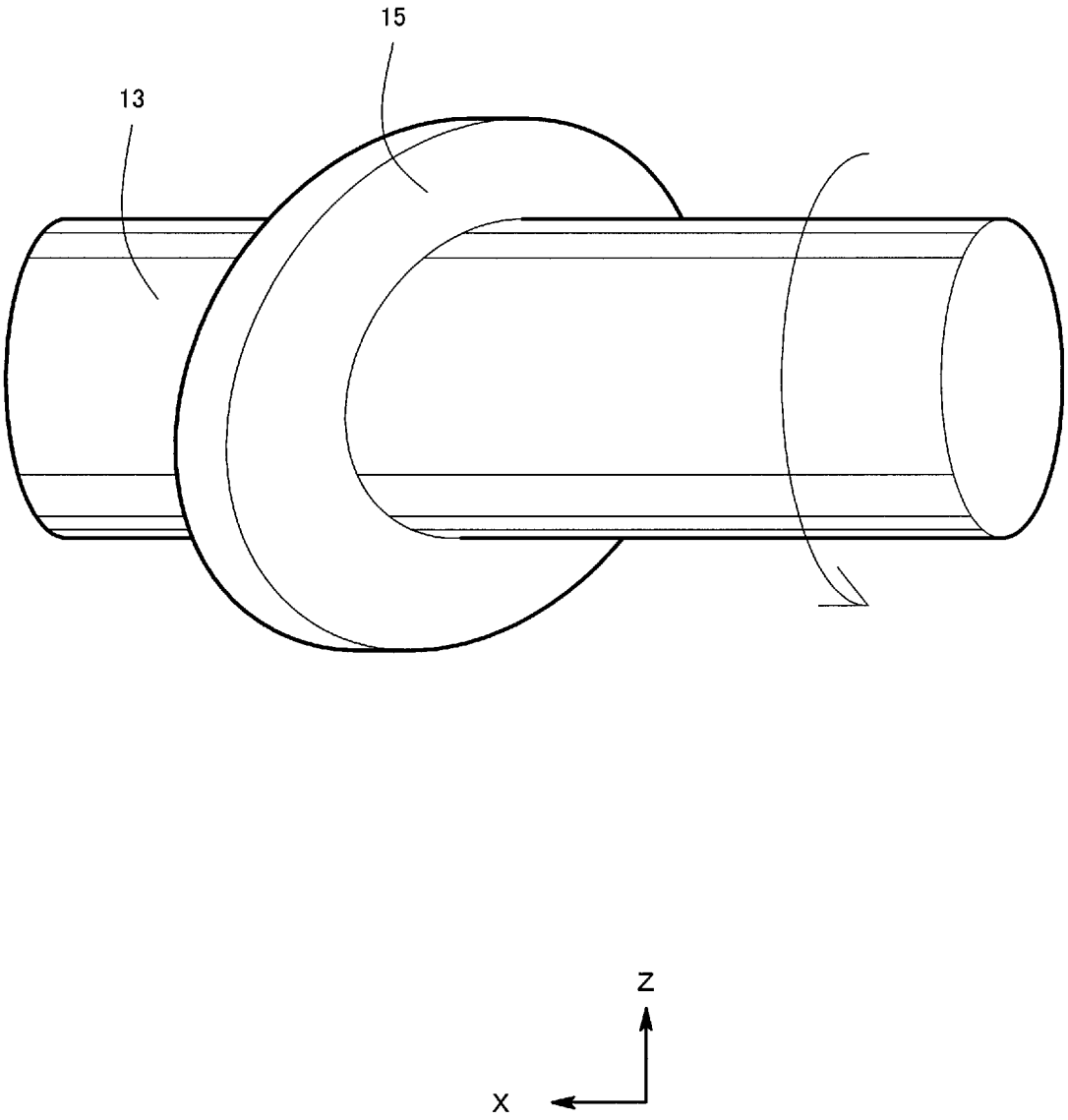
FIG. 2 is a perspective diagram showing an example of a cam mechanism of a non-pulsating pump according to an embodiment of the present disclosure.

A non-pulsating pump 100 according to an embodiment of the present disclosure will now be described with reference to the drawings. In FIGS. 1 to 5, 16, and 17, a direction of reciprocating motions of crossheads 28 and 48 is set as an X axis. A pressurizing direction of pump chambers 220 and 240 is set as a positive direction. Further, a Y axis and a Z axis are defined to be perpendicular to the X axis. An X-Y plane is a horizontal plane. The Z axis is a vertical axis.

The non-pulsating pump 100 of the present embodiment is used in a process that requires supply of a fluid continuously and at a constant flow rate. In addition, for example, in the non-pulsating pump 100 of the present disclosure, supply of fluid with a high pressure is enabled, and, for example, the fluid can be supplied with a pressure of about 40 MPa. For example, the non-pulsating pump of the present embodiment is used for a mixing process of medicines or paints.

The non-pulsating pump 100 according to the present embodiment comprises a drive mechanism 250, a plurality of reciprocating pumps 20 and 40, a stroke adjustment mechanism 80, and a control unit 160.

The drive mechanism 250 drives the plurality of reciprocating pumps 20 and 40. The drive mechanism 250 comprises a frame 10, a drive motor 11, a shaft 12, a rotary encoder 130, a cam mechanism 16, and crossheads 28 and 48.

The frame 10 supports a driving element in the drive mechanism 250. For example, the frame 10 is made from a metal material, and has a hollow structure. For example, the cam mechanism 16 and the stroke adjustment mechanisms 80 and 80 are housed in the frame 10. In addition, the frame 10 is supported on a fixing element such as a base.

The drive motor 11 rotationally drives the shaft 12. The drive motor 11 may be any motor which can rotate with uniform velocity, and is formed from, for example, an inverter motor. A rotational drive force of the drive motor 11 is transmitted to the shaft 12 having a small size and a shaft 13 having a large size and provided beyond the shaft 12.

The rotary encoder 130 detects a rotational phase of the drive motor 11. The rotary encoder 130 includes a slit disk 131, a light emitting element 132, and a light receiving element 133.

The slit disk 131 is engaged with the shaft 12, and is rotated along with the shaft 12. In the slit disk 131, a plurality of slits are formed to penetrate through in an axial direction, radially from a center of rotation of the shaft 12. In order to enable an absolute position (absolute angle) of a rotation cam 15 to be obtained, one of the plurality of slits, for example, may be formed in a different shape from the other slits. For example, one slit having a wider width in a circumferential direction in comparison to other slits may be formed in the slit disk 131.

The light emitting element 132 and the light receiving element 133 are provided with the slit of the slit disk 131 therebetween in the axial direction. The light receiving element 133 detects blocking/passing of light illuminated from the light emitting element 132 by the slit disk 131, and transmits a detection signal thereof to the control unit 160. As will be described later, the control unit 160 receives the detection signal from the light receiving element 133, and determines a rotational phase of the rotation cam 15, that is, a cam angle θ.

Alternatively, in place of the slit disk 131, the light emitting element 132, and the light receiving element 133, a protrusion may be provided along the circumference on a disk surface, and may be detected by a proximity sensor.

The cam mechanism 16 converts a rotational motion of the drive motor 11 into a reciprocating motion. The cam mechanism 16 comprises the shaft 13, the rotation cam 15, and rollers 29 and 49. The rotation cam 15 is engaged with the shaft 13, and is rotated along with the shaft 13. As exemplified in FIG. 2, the rotation cam 15 is formed in an approximately circular disk shape. The rotation cam 15 is engaged with the shaft 13 with a circular disk surface thereof being non-perpendicular, that is, inclined with respect to, the axial direction of the shaft 13. Alternatively, in place of engaging the rotation cam 15 to the shaft 13, the shaft 13 and the rotation cam 15 may be integrally cut out.

Figure 7:
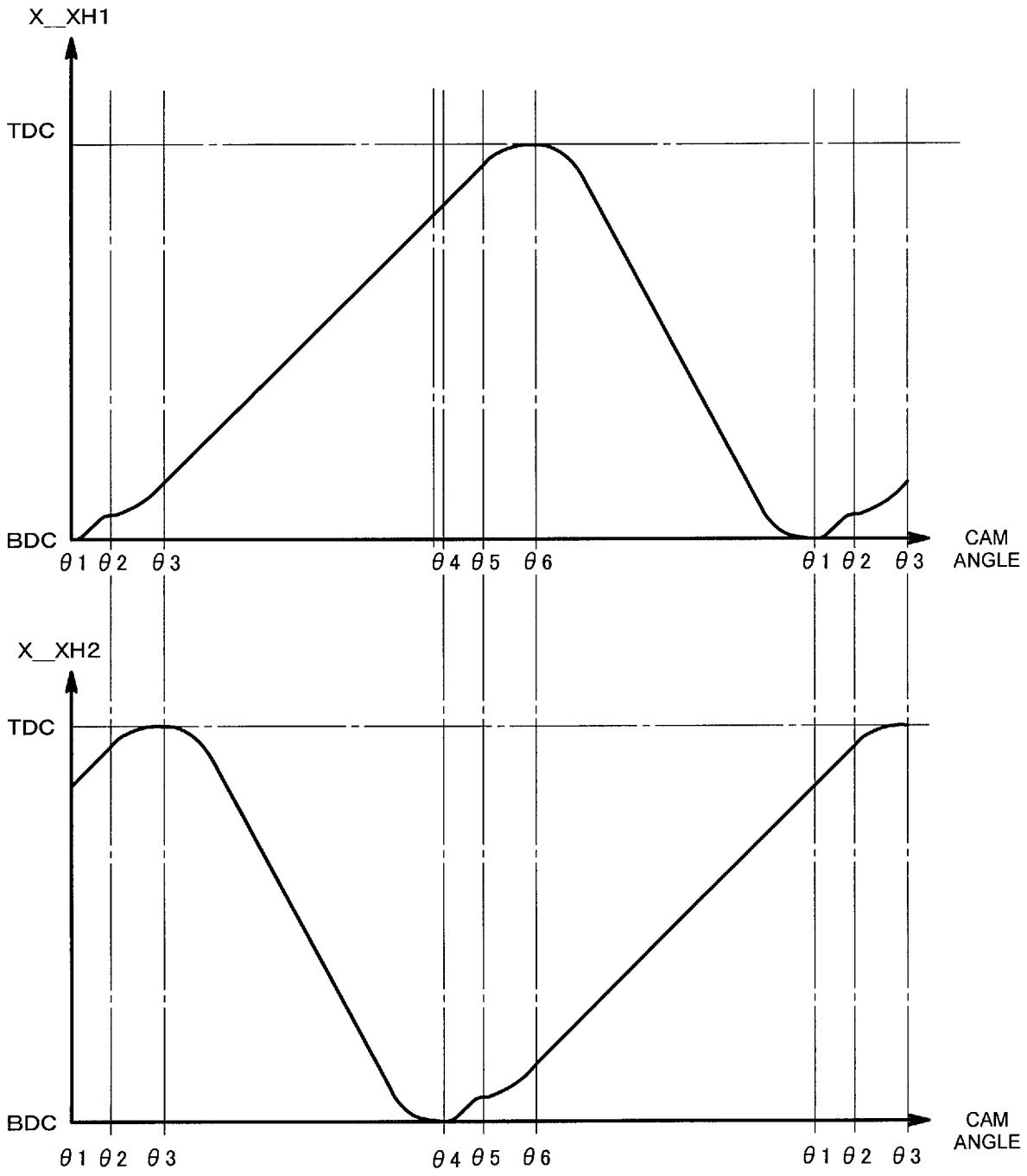
FIG. 7 is a graph for explaining a change of a position of a crosshead with respect to a cam angle, in a non-pulsating pump according to an embodiment of the present disclosure.

With the circular disk surface of the rotation cam 15 being inclined with respect to the axial direction of the shaft 13, the crossheads 28 and 48 connected to the rotation cam 15 are moved forward and backward according to the rotational phase of the rotation cam 15. The shape of the rotation cam 15 is determined such that the forward and backward displacements of the crossheads 28 and 48, that is, strokes X_XH1 and X_XH2, have waveforms (profiles) as shown in FIG. 7.

The rollers 29 and 49 are configured such that rotational shafts thereof (shown by broken lines) are respectively inserted into the crossheads 28 and 48, orthogonal to the forward/backward movement directions of the crossheads 28 and 48. A pair of the rollers 29 and 49 are provided along the forward/backward movement directions of the crossheads 28 and 48, respectively, and a peripheral portion of the rotation cam 15 is sandwiched therebetween.

The crossheads 28 and 48 are reciprocated by the cam mechanism 16. The crossheads 28 and 48 have, for example, a circular column shape extending in the forward/backward movement direction, and holes with bottoms 28*a* (refer to FIG. 3) are formed at front ends thereof (ends in the direction of movement).

The crossheads 28 and 48 are reciprocated by the cam mechanism 16 with a predetermined phase difference. For example, in FIG. 1, a pair of crossheads 28 and 48 are provided, and are connected to the rotation cam 15 with a phase difference of 180°. For example, the crossheads 28 and 48 are placed on a same plane as the shaft 13, with the shaft 13 therebetween.

The reciprocating pumps 20 and 40 are driven by the drive mechanism 250. The reciprocating pumps 20 and 40 comprise pump chambers 220 and 240, plungers 26 and 46, intake valves 31 and 51, and discharge valves 33 and 53, respectively.

The plungers 26 and 46 are connected to the crossheads 28 and 48 via the stroke adjustment mechanisms 80 and 80, respectively. The plungers 26 and 46 reciprocate with the reciprocating motions of the crossheads 28 and 48, respectively. As will be described later, the drive forces are transmitted by the stroke adjustment mechanism 80 and 80 provided between the plungers 26 and 46 and the crossheads 28 and 48, respectively, to the plungers 26 and 46 in a state with "play" with respect to the reciprocating motions of the crossheads 28 and 48, respectively.

The pump chambers 220 and 240 have hydraulic chambers 22 and 42 and fluid chambers 25 and 45, respectively. The hydraulic chambers 22 and 42 and the fluid chambers 25 and 45 are respectively separated by flexible diaphragms 23 and 43. The hydraulic chambers 22 and 42 are surrounded by casings of the pump chambers 220 and 240, the diaphragms 23 and 43, and packings 27 and 47, respectively, and oil of a predetermined viscosity is sealed. Front portions of the plungers 26 and 46 are inserted into the hydraulic chambers 22 and 42, respectively, in a manner to be sandwiched by the packings 27 and 47. Thus, the inner pressures of the hydraulic chambers 22 and 42 and the fluid chambers 25 and 45 change with the forward and backward movements of the plungers 26 and 46, respectively.

Fluid supplied to a common intake line 35 and to a common discharge line 36 is introduced to or discharged from the fluid chambers 25 and 45. For example, when the non-pulsating pump 100 of the present embodiment is used for a mixing process of medicines or paints, liquids which are materials of the medicine or the paint are introduced into or discharged from the fluid chambers 25 and 45. The fluid chambers 25 and 45 are formed from, for example, a corrosion-resistant member.

Intake lines 30 and 50 branched from the common intake line 35 are connected to (in communication with) the fluid chambers 25 and 45 via the intake valves 31 and 51, respectively. Similarly, discharge lines 32 and 52 merging to the common discharge line 36 are connected to (in communication with) the fluid chambers 25 and 45 via the discharge valves 33 and 53, respectively.

As described above, the inner pressures of the hydraulic chambers 22 and 42 change with the forward/backward movements of the plungers 26 and 46, respectively. The inner pressures of the fluid chambers 25 and 45, separated from the hydraulic chambers 22 and 42 by the flexible diaphragms 23 and 43, respectively, change following the changes of the inner pressures of the hydraulic chambers 22 and 42, respectively. More specifically, the inner pressures of the hydraulic chambers 22 and 42 are respectively equal to the inner pressures of the fluid chambers 25 and 45.

The intake valves 31 and 51 are valves connecting the common intake line 35 and the fluid chambers 25 and 45 of the pump chambers 220 and 240, respectively. The intake valves 31 and 51 have the sides of the fluid chambers 25 and 45 of the pump chambers 220 and 240, respectively, as a back pressure side. That is, when the inner pressures of the fluid chambers 25 and 45 respectively exceed the pressure of the common intake line 35, the intake valves 31 and 51 are respectively closed. In addition, when the inner pressures of the fluid chambers 25 and 45 respectively become less than or equal to the pressure of the common intake line 35, the intake valves 31 and 51 are respectively opened, and the fluid (liquid) of the common intake line 35 flows into the fluid chambers 25 and 45, respectively. In order to strictly balance the pressures controlling the closing/opening of the intake valves 31 and 51, an urging member such as a spring does not need to be provided on a valve member of the intake valves 31 and 51.

The discharge valves 33 and 53 are valves respectively connecting the common discharge line 36 and the fluid chambers 25 and 45 of the pump chambers 220 and 240. The discharge valves 33 and 53 have the sides at the common discharge line 36 as a back pressure side. That is, when the pressure of the common discharge line 36 exceeds the inner pressures of the fluid chambers 25 and 45, respectively, the discharge valves 33 and 53 are respectively closed. In addition, when the inner pressures of the fluid chambers 25 and 45 respectively become higher than or equal to the pressure of the common discharge line 36, the discharge valves 33 and 53 are respectively opened, and the fluid in the fluid chambers 25 and 45 is respectively sent to the common discharge line 36. In order to strictly balance the pressures controlling the closing/opening of the discharge valves 33 and 53, an urging member such as a spring does not need to be provided on a valve member of the discharge valves 33 and 53.

In the pump chambers 220 and 240, inner pressure sensors 64 and 65 for detecting the inner pressures thereof are respectively provided. The inner pressure sensors 64 and 65 are connected to, for example, the hydraulic chambers 22 and 42, respectively. Because the inner pressures P_OR1 and P_OR2 of the hydraulic chambers 22 and 42 are respectively equal to the inner pressures of the fluid chambers 25 and 45, as described above, pressure values detected by the inner pressure sensors 64 and 65 may be considered to be the inner pressures of the fluid chambers 25 and 45, respectively. The inner pressures P_OR1 and P_OR2 of the hydraulic chambers 22 and 42 detected by the inner pressure sensors 64 and 65, respectively, are transmitted to the control unit 160.

It is also possible to provide the inner pressure sensors 64 and 65 respectively in the fluid chambers 25 and 45. However, in such a case, corrosion-resistant inner pressure sensors 64 and 65 need to be used depending on the fluid to be handled. On the contrary, when the inner pressure sensors 64 and 65 are provided respectively in the hydraulic chambers 22 and 42, an advantage may be obtained that the inner pressure sensors 64 and 65 do not need to be corrosion resistant.

Moreover, a line pressure sensor 63 is provided on the common discharge line 36. The line pressure sensor 63 detects a pressure (pipe pressure, line pressure) P_L of the common discharge line. For example, a corrosion-resistant pressure sensor is used as the line pressure sensor 63.

Alternatively, in place of the use of the line pressure sensor 63, the inner pressure sensors 64 and 65 may be used to detect the line pressure P_L. As will be described later, when the fluid chambers 25 and 45 are opened with respect to the common discharge line 36, the pressures of the fluid chambers 25 and 45 and the common discharge line 36 become equal to each other. In addition, theoretically, the inner pressures of the fluid chambers 25 and 45 are respectively equal to the inner pressures of the hydraulic chambers 22 and 42. Therefore, the inner pressures of the fluid chambers 25 and 45 at the time of opening, or the inner pressures of the hydraulic chambers 22 and 42 at the time, may be detected as the line pressure P_L. In such a configuration, an advantage may be obtained that the pressure sensor does not need to be provided in a flow path of the fluid to be handled.

The stroke adjustment mechanisms 80 are provided between rear ends (ends on the sides spaced away from the pump chambers 220 and 240) of the plungers 26 and 46 and front ends of the crossheads 28 and 48, respectively. The stroke adjustment mechanisms 80 adjust effective stroke lengths of the reciprocating motions of the plungers 26 and 46 by the crossheads 28 and 48. As exemplified in FIGS. 1 and 3, the stroke adjustment mechanisms 80 comprise bodies 81, stoppers 82, reinforcement members 83, coil springs 84, support rings 85, bolts 86 and 87, worm gears 121 and 141, worm wheels 122 and 142, and adjustment motors 120 and 140, respectively.

Figure 3:
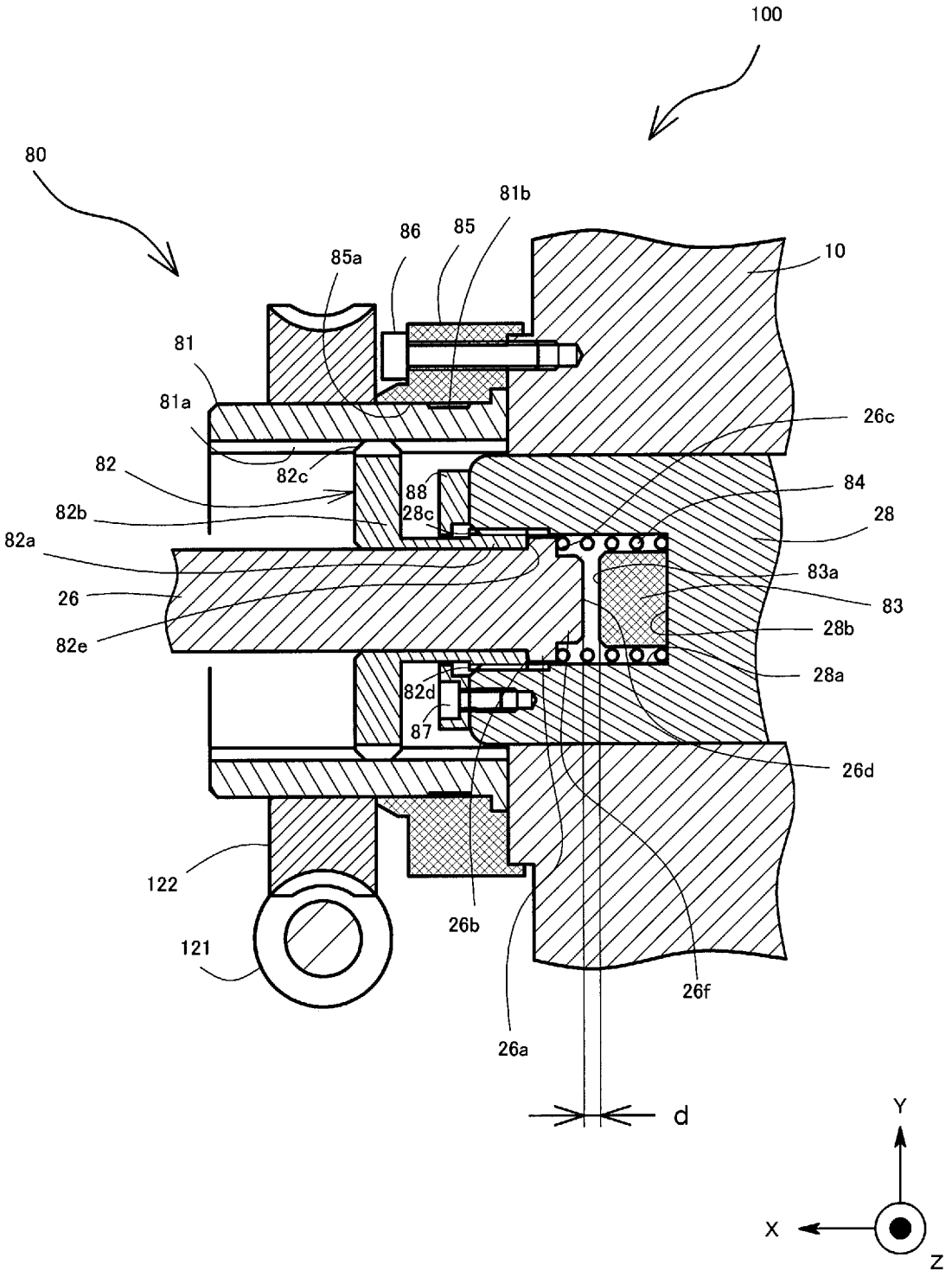
FIG. 3 is a cross sectional diagram showing a structure of a stroke adjustment mechanism of a non-pulsating pump according to an embodiment of the present disclosure, and showing a positional relationship between a crosshead and a plunger at the start of a compression step.
Figure 5:
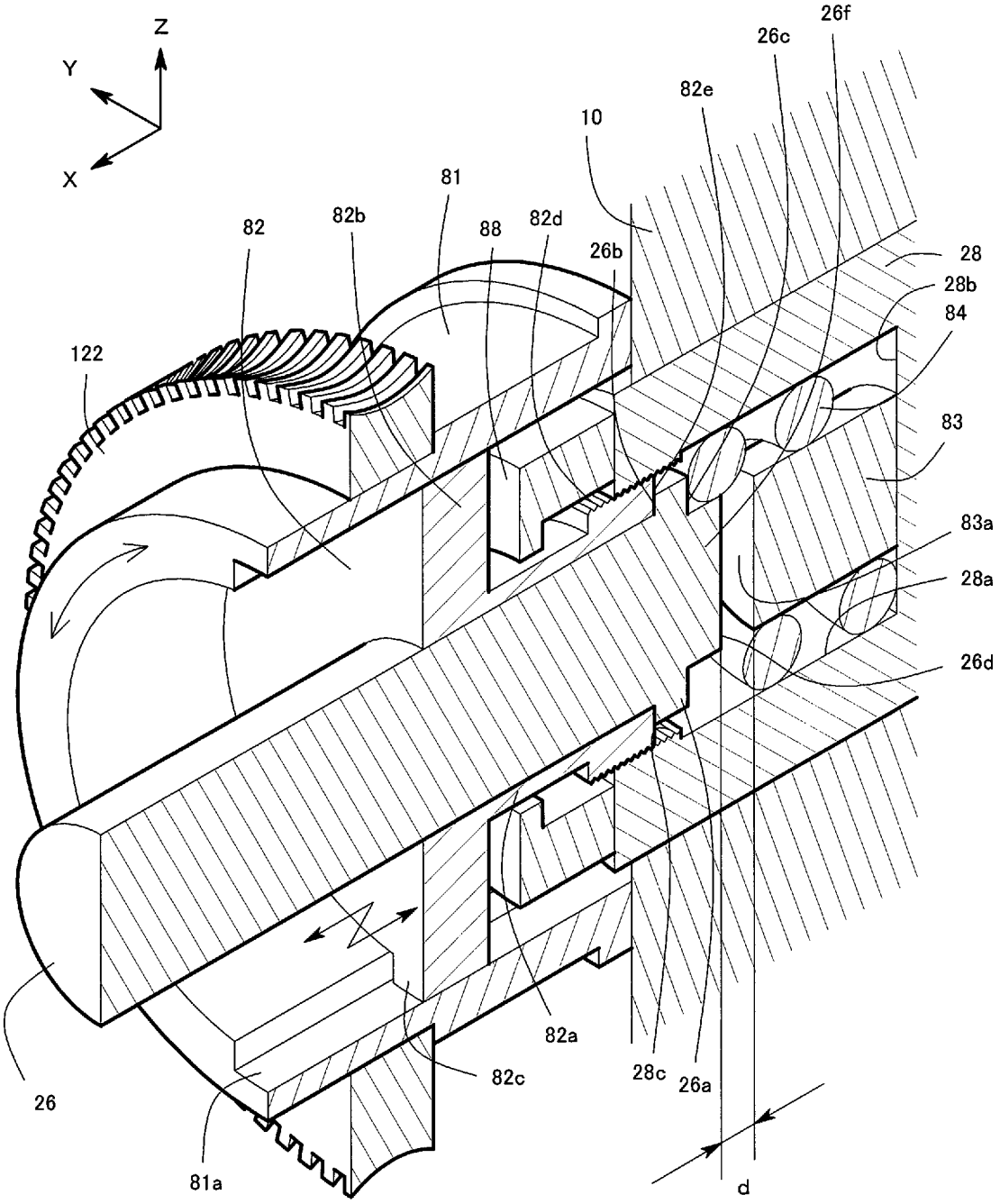
FIG. 5 is a cross sectional perspective diagram showing a structure of the stroke adjustment mechanism shown in FIG. 3.

FIGS. 3 and 5 exemplify side cross sectional diagrams of the stroke adjustment mechanism 80 on the side of the reciprocating pump 20. The stroke adjustment mechanism 80 on the side of the reciprocating pump 40 has a similar structure. More specifically, in the following description, the number "2" in the tens digit position may be replaced with "4" in the reference numerals of the constituting elements, to describe the structure of the stroke adjustment mechanism 80 on the side of the reciprocating pump 40.

The hole with the bottom 28*a* is formed at a front end of the crosshead 28, formed in the axial direction. A rear end portion 26*f* of the plunger 26 is inserted into this hole with the bottom 28*a*. In addition, the reinforcement member 83 is provided on a bottom surface 28*b* of the hole with the bottom 28*a*. A front end surface 83*a* of the reinforcement member 83 and a rear end surface 26*d* of the plunger 26 oppose each other along the forward/backward movement direction of the plunger 26.

A diameter of the reinforcement member 83 is formed to be smaller than an inner size of the hole with the bottom 28*a*, and the coil spring 84 which is an urging member is provided at an outer circumference of the reinforcement member 83. A rear end of the coil spring 84 abuts the bottom surface 28*b* of the hole with the bottom 28*a*, and a front end of the coil spring 84 abuts a rear surface 26*c* of an enlarged-diameter portion 26*a* of the plunger 26.

At a front in relation to the rear end portion 26*f* of the plunger 26, the enlarged-diameter portion 26*a* having a larger diameter than the rear end portion 26*f* is provided. The front end of the coil spring 84 is fitted to the rear end portion 26*f*, and abuts the rear surface 26*c* of the enlarged-diameter portion 26*a*. A front surface 26*b* of the enlarged-diameter portion 26*a* abuts a rear surface 82*e* of the stopper 82.

The stopper 82 is a member having an approximately circular tubular shape, and comprises a circular ring portion 82*a* and an arm 82*b* in front of the circular ring portion 82*a*. The stopper 82 determines a range of a free reciprocating motion of the plunger 26. An inner circumferential surface of the stopper 82 is slidable with respect to an outer circumferential surface of the plunger 26. More specifically, the stopper 82 is slidable with respect to the plunger 26 in the forward/backward movement direction (X axis direction) and in the circumferential direction.

An outer thread 82*d* is formed on an outer circumferential surface of the circular ring portion 82*a* of the stopper 82, and engages an inner thread 28*c* which is formed on an inner circumferential surface of the hole with the bottom 28*a* of the crosshead 28. With this engagement, the stopper 82 reciprocates with the crosshead 28.

When the outer thread 82*d* is rotated with respect to the inner thread 28*c*, the stopper 82 correspondingly relatively moves with the crosshead 28. With this relative movement, a separation distance d between the rear end surface 26*d* of the plunger 26 and the front end surface 83*a* of the reinforcement member 83 changes. The separation distance d corresponds to a loss when the reciprocating drive force is transmitted from the crosshead 28 to the plunger 26. In other words, the separation distance d is a range in which the free reciprocating motion of the crosshead 28 along the reciprocating motion direction is possible, and corresponds to an ineffective stroke length.

On the front end of the crosshead 28, a stopper lock 88 is fastened by the bolt 87. The stopper lock 88 is formed with a side cross section of a hook shape, and a front end of the stopper lock 88 protrudes on the side of the center axis of the plunger 26. With this protruding portion, excessive rotation of the stopper 82 is prevented. That is, detachment of the outer thread 82*d* from the inner thread 28*c* due to excessive rotation is prevented by the stopper lock 88.

The arm 82*b* of the stopper 82 protrudes to an outer side in the radial direction in relation to the circular ring portion 82*a*. A key 82*c* which is fitted to a key groove 81*a* of the body 81 is formed on a circumferential end of the arm 82*b*. The key groove 81*a* is formed on an inner circumferential surface of the body 81 along the center axis direction thereof, and the key 82*c* can move forward and backward in the central axis direction, that is, in the forward/backward movement direction of the crosshead 28, along the key groove 81*a*.

When the body 81 rotates with the center axis direction as a center of rotation, the stopper 82 rotates with the body 81, due to the fitting of the key groove 81*a* and the key 82*c*. When the stopper 82 rotates, the outer thread 82*d* rotates with respect to the inner thread 28*c*, and the ineffective stroke length d changes.

The body 81 is provided at a front end of the frame 10, and is rotatable with respect to the frame 10. For example, the support ring 85 (refer to FIG. 3) is fastened to the frame 10 via the bolt 86, on an outer circumferential surface of the body 81. An inner circumferential surface 85*a* of the support ring 85 and an outer circumferential surface 81*b* of the body 81 can slide with respect to each other along the circumferential direction thereof.

The worm wheel 122 is fixed on the outer circumferential surface 81*b* of the body 81, and rotates the body 81. The worm wheel 122 engages the worm gear 121. The worm gear 121 connects to the adjustment motor 120 (refer to FIG. 1). The adjustment motor 120 is a motor which can rotate forward and reversely, and is formed from, for example, a reversible motor. In response to the rotational driving of the adjustment motor 120, the worm gear 121 rotates, and the worm wheel 122 is consequently rotated. The rotational drive is transmitted to the body 81 and the stopper 82, and the stopper 82 is moved forward and backward along the reciprocating motion direction thereof. As a result, the ineffective stroke length d changes.

Figure 4:
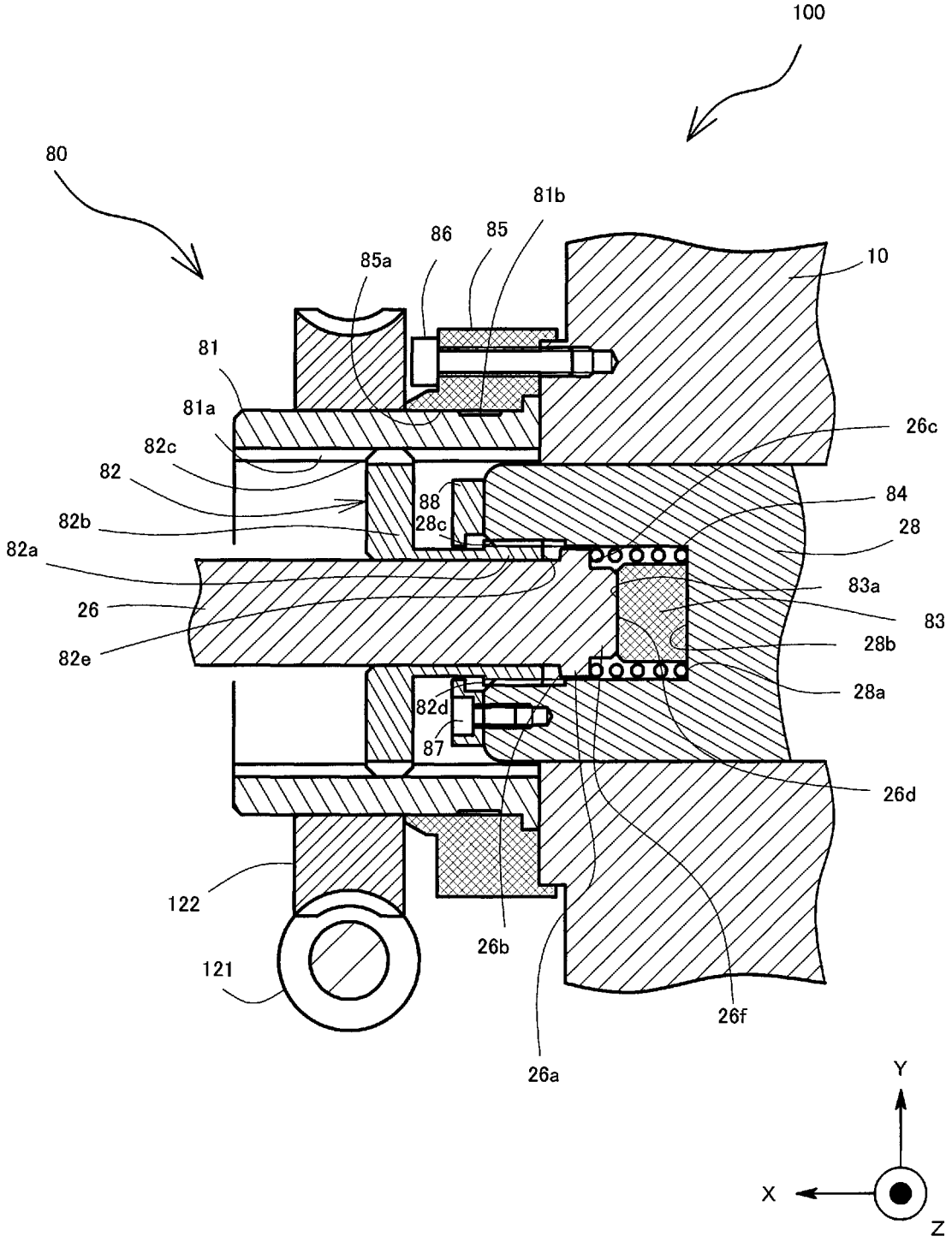
FIG. 4 is a cross sectional diagram showing a structure of the stroke adjustment mechanism shown in FIG. 3, and showing a state in which a gap between the crosshead and the plunger becomes zero during the compression step.

FIGS. 3 and 4 exemplify a process of transmission of the drive force from the crosshead 28 to the plunger 26. With a forward movement of the crosshead 28, the stopper lock 88 and the stopper 82 move forward. On the other hand, the plunger 26 is slidable in the forward/backward movement direction with respect to the stopper 82, and, because the ineffective stroke length d is provided between the rear end surface 26*d* of the plunger 26 and the front end surface 83*a* of the reinforcement member 83, the forward movement of the plunger 26 is slowed, while contracting the coil spring 84.

More specifically, when the crosshead 28 moves forward past a bottom dead center, the drive force is transmitted to the plunger 26 via the coil spring 84. The front end of the plunger 26 is inserted into the hydraulic chamber 22, and, with the forward movement of the plunger 26, a pressure (inner pressure) received by the front surface of the plunger 26 is increased. When the inner pressure exceeds an elastic pressure of the coil spring 84, the coil spring 84 is contracted. In this process, the separation distance d is reduced.

With further reference to FIG. 4, when the ineffective stroke length d becomes 0 and the rear end surface 26*d* of the plunger 26 abuts the front end surface 83*a* of the reinforcement member 83, the crosshead 28 pushes the plunger 26 forward. After this point, the stroke length of the crosshead 28 until the crosshead 28 reaches a top dead center, that is, a point where the position of the crosshead 28 is closest to the pump chamber 220, is an effective stroke length in which the drive force is transmitted to the plunger 26.

After reaching the top dead center, the crosshead 28 moves backward. During this process, the coil spring 84 urges the plunger 26 forward. With this urging, the front surface 26*b* of the enlarged-diameter portion 26*a* of the plunger 26 abuts the rear surface 82*e* of the stopper 82. With this process, the ineffective stroke length d is secured. After the crosshead 28 reaches the bottom dead center, that is, a point farthest away from the pump chamber 220, the crosshead 28 again moves forward.

More specifically, after the crosshead 28 passes the top dead center, the plunger 26 is pushed by the inner pressure of the hydraulic chamber 22 and is moved backward. With the backward movement of the plunger 26, the inner pressure of the hydraulic chamber 22 is reduced, and finally becomes the same pressure as the common intake line 35. Here, a spring constant or the like of the coil spring 84 is determined such that the elastic pressure of the coil spring 84 is higher than the line pressure of the common intake line 35. Therefore, during the process of the reduction of the inner pressure of the hydraulic chamber 22, the contracted coil spring 84 pushes the plunger 26 forward, and becomes extended. In this state, the crosshead 28 reaches the bottom dead center.

With reference to FIG. 1, the control unit 160 controls driving of the drive motor 11, and the adjustment motors 120 and 140. Various pressure detection values from the inner pressure sensors 64 and 65 and the line pressure sensor 63 are transmitted to the control unit 160. In addition, the control unit 160 receives the detection signal from the light receiving element 133 of the rotary encoder 130, and determines the cam angle θ of the rotation cam 15.

As exemplified in FIG. 1, the control unit 160 comprises an input unit 161, an output unit 162, a CPU 163, and a memory 164. The control unit 160 is formed from, for example, a computer. These hardware structures (virtually) form a functional block as exemplified in FIG. 6.

Figure 6:
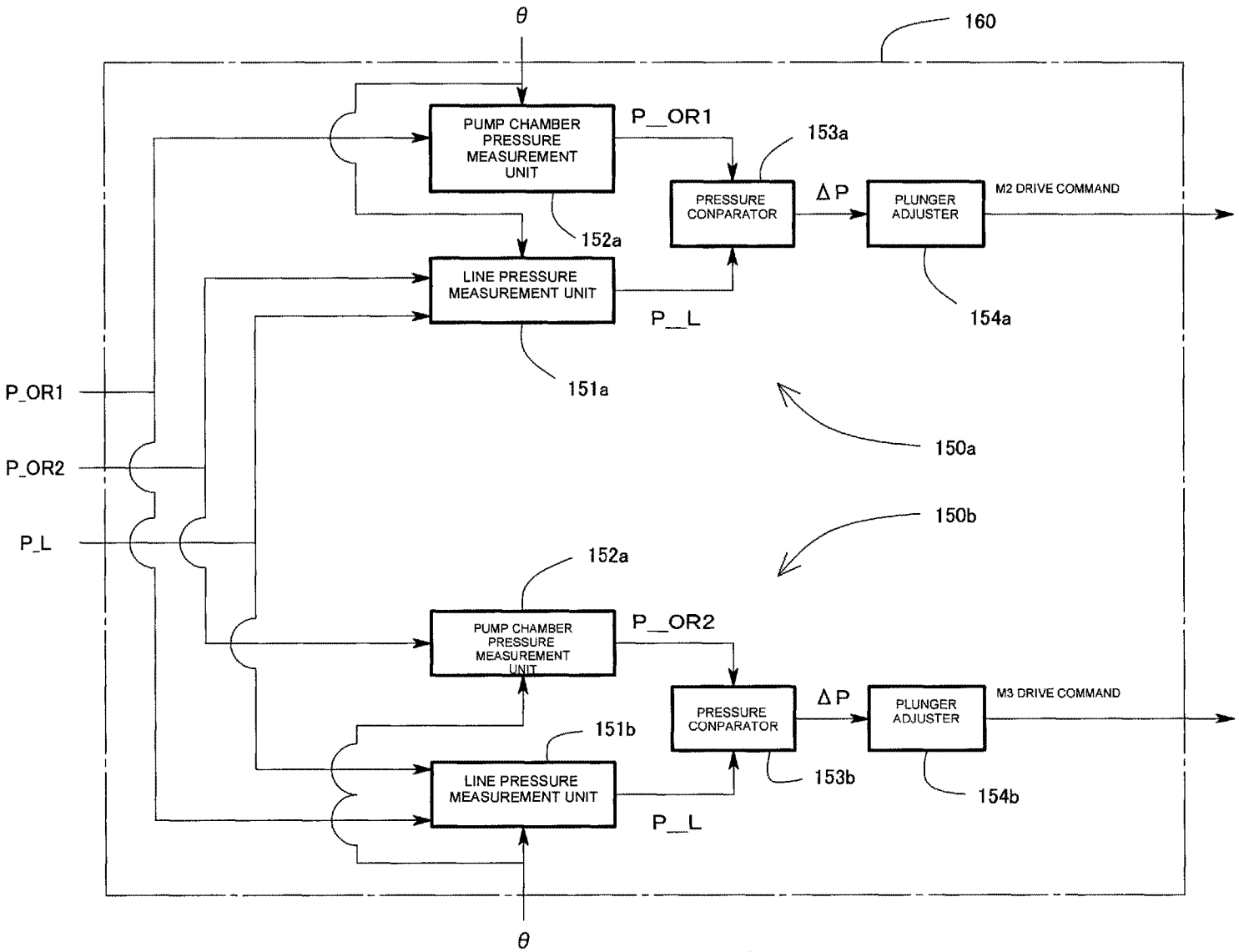
FIG. 6 is a diagram for explaining a block structure of a control unit.

FIG. 6 shows functional blocks related to control of the stroke adjustment by the adjustment motors 120 and 140. The control unit 160 comprises stroke adjustment control units 150*a* and 150*b*. The stroke adjustment control units 150*a* and 150*b* comprise line pressure measurement units 151*a* and 151*b*, pump chamber pressure measurement units 152*a* and 152*b*, pressure comparators 153*a* and 153*b*, and plunger adjusters 154*a* and 154*b*, respectively. The stroke adjustment control units 150*a* and 150*b* can be operated independently from each other. Contents of the calculations of the functional blocks of these control units will be described later.

<Operation of Non-Pulsating Pump>

With reference to FIGS. 7 to 11, an operation of the non-pulsating pump 100 according to the present embodiment will be described. In order to facilitate explanation, in FIGS. 7 to 11, the ineffective stroke length d is set to 0. That is, the reciprocating motion drive forces of the crossheads 28 and 48 are transmitted to the plungers 26 and 46, respectively, without any loss. Further, the driving of the drive motor 11 is assumed to be a uniform velocity rotation. Moreover, in FIGS. 7 to 11, various waveforms are exemplified in an ideal operation state in which no pulsation occurs.

FIG. 7 exemplifies graphs of positions, of the crossheads 28 and 48, in the X axis direction X_XH1 and X_XH2, with respect to a cam angle θ of the rotation cam 15. The graphs show the cam angle θ on a horizontal axis and the positions X_XH1 and X_XH2 of the crossheads 28 and 48 on a vertical axis. In addition, the bottom dead center BDC and the top dead center TDC are shown on the vertical axis. As shown by a dot-and-chain line of FIG. 7, the graphs on an upper part and a lower part are synchronized. Because the ineffective stroke length d=0 as already described, the positions (strokes) X_XH1 and X_XH2 of the crossheads 28 and 48 are equal to positions (stokes) X_PG1 and _XPG2 of the plungers 26 and 46, respectively (X_XH1=X_PG1 and X_XH2=X_PG2).

Figure 8:
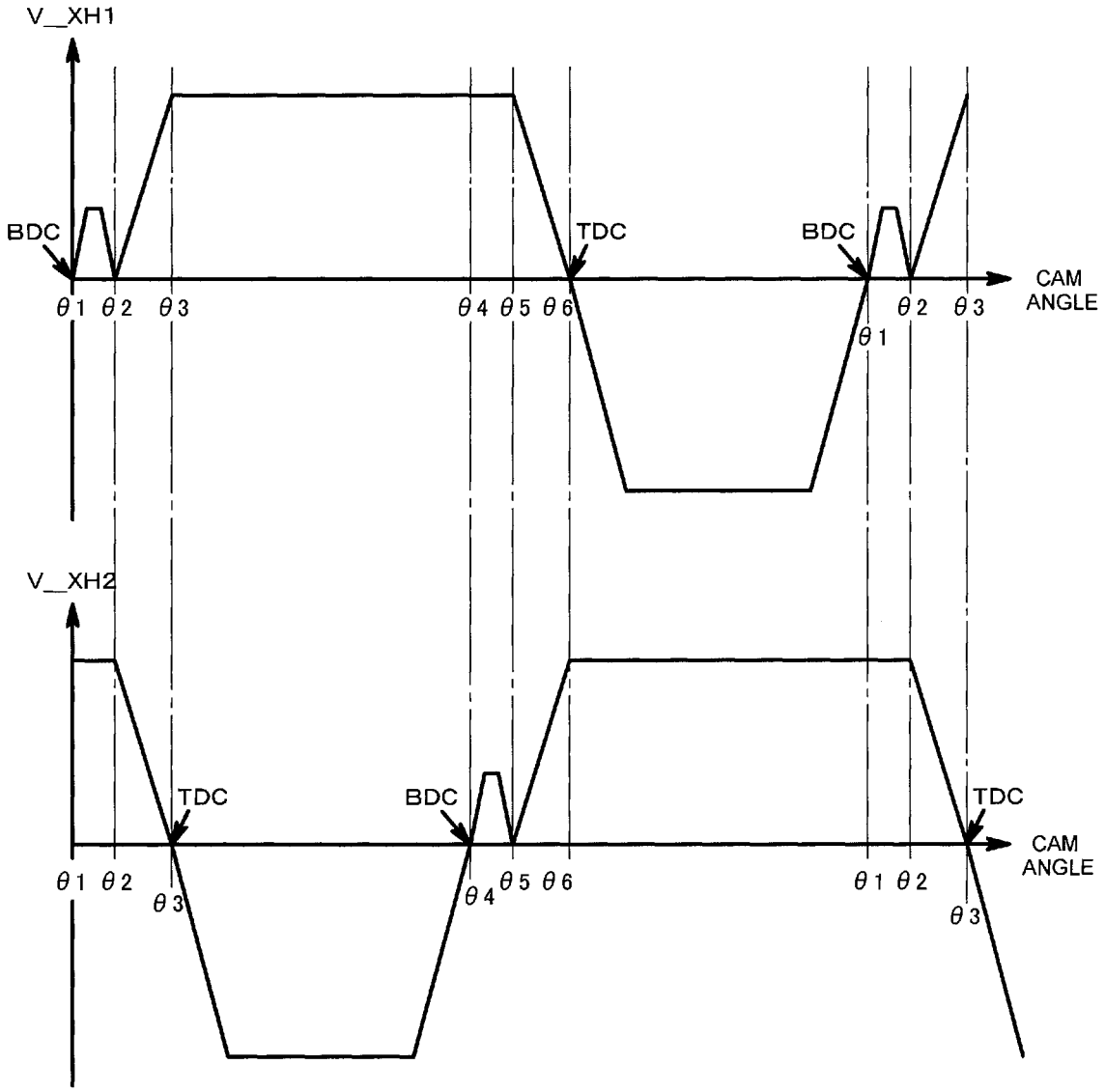
FIG. 8 is a graph for explaining a change of a velocity of a crosshead with respect to a cam angle, in a non-pulsating pump according to an embodiment of the present disclosure.

FIG. 8 exemplifies changes of velocities of the crossheads 28 and 48 with respect to the cam angle θ. The graphs of FIG. 8 show the cam angle θ on a horizontal axis and reciprocating motion velocities V_XH1 and V_XH2 of the crossheads 28 and 48 on a vertical axis. A positive direction of the vertical axis shows a velocity in the forward movement direction. The graphs at an upper part and a lower part of FIG. 8 are synchronized.

Figure 9:
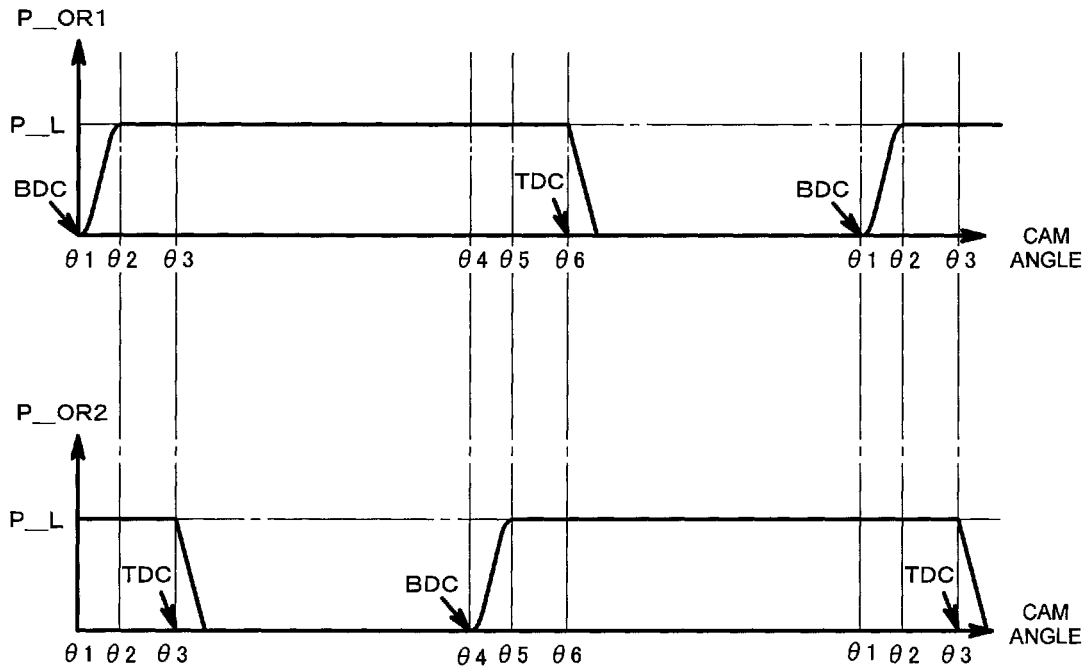
FIG. 9 is a graph for explaining a change of an inner pressure of a pump chamber with respect to a cam angle, in a non-pulsating pump according to an embodiment of the present disclosure.

FIG. 9 exemplifies changes of inner pressures of the pump chambers 220 and 240, more accurately, the inner pressures of the hydraulic chambers 22 and 42 which are detection targets of the inner pressure sensors 64 and 65, with respect to the cam angle θ. The graphs of FIG. 9 show the cam angle θ on a horizontal axis and the inner pressures P_OR1 and P_OR2 of the hydraulic chambers 22 and 42 on a vertical axis. In addition, graphs at an upper part and a lower part of FIG. 9 are synchronized.

Figure 10:
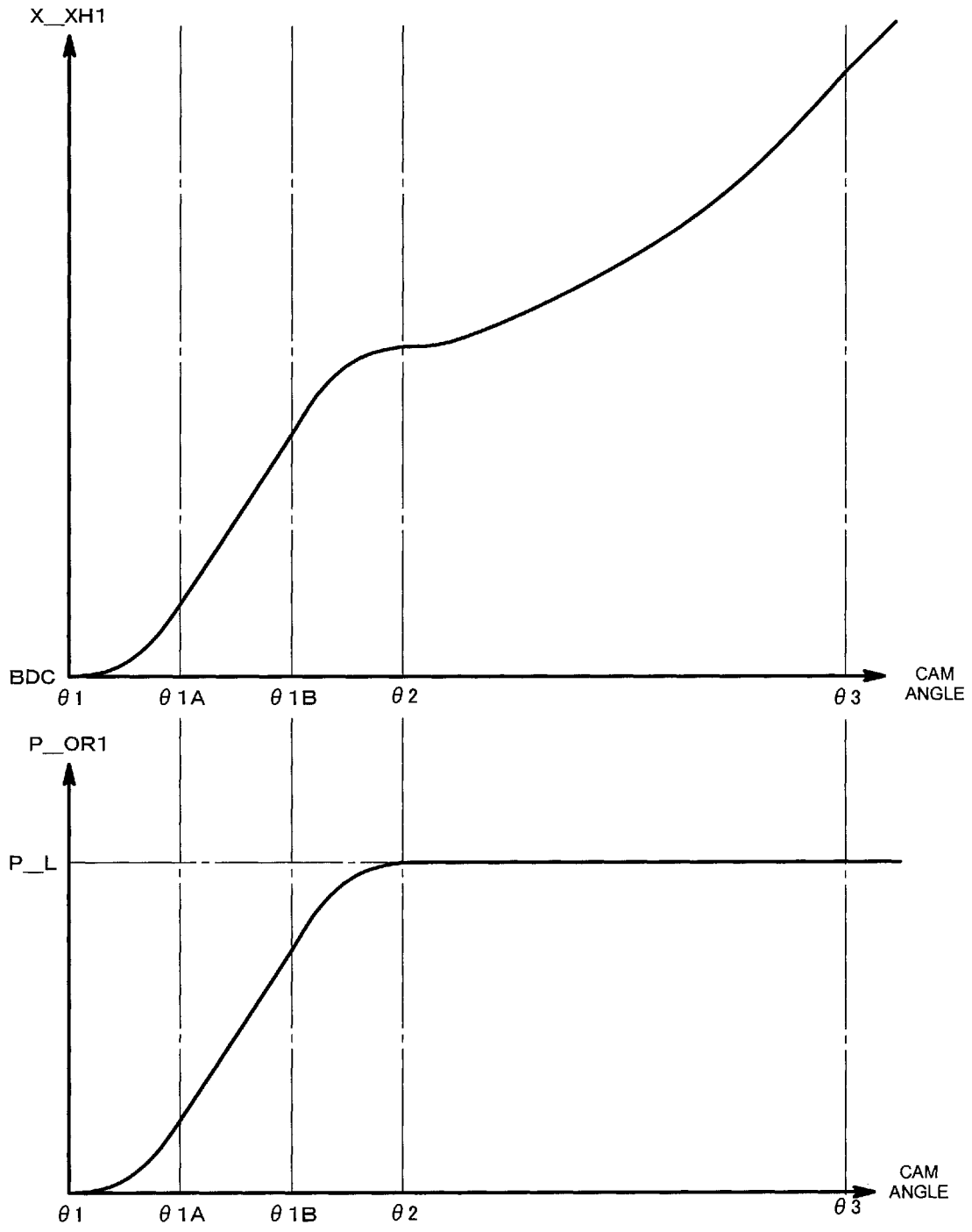
FIG. 10 is a graph for explaining a change of a position of a crosshead and a change of an inner pressure of a pump chamber with respect to a cam angle in a compression step, in a non-pulsating pump according to an embodiment of the present disclosure.

FIG. 10 exemplifies a change of the position X_XH1 of the crosshead 28 (upper part) and a change of the inner pressure P_OR1 of the hydraulic chamber 22 (lower part), from the bottom dead center BDC of the crosshead 28 to the cam angle of θ3. The graphs at the upper part and the lower part of FIG. 10 are synchronized.

Figure 11:
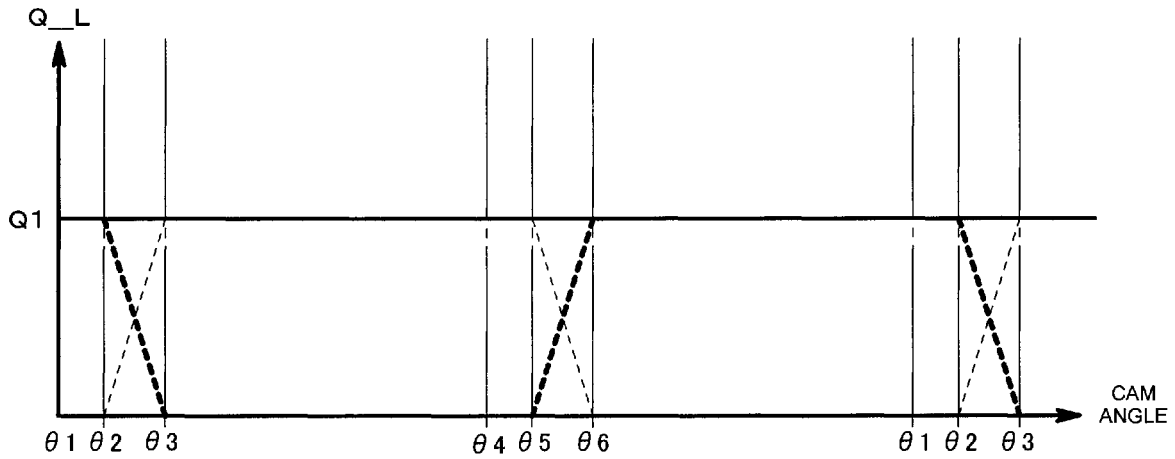
FIG. 11 is a graph for explaining a line flow rate (during non-pulsation) in a non-pulsating pump according to an embodiment of the present disclosure.

FIG. 11 exemplifies the flow rate Q_L of the common discharge line 36. The graph of FIG. 11 shows the cam angle θ on a horizontal axis, and the flow rate Q_L on a vertical axis. A narrow broken line shows a flow rate from the fluid chamber 25, and a thick broken line shows a flow rate from the fluid chamber 45.

With reference to FIG. 7, the rotation cam 15 is formed in such a shape that the crossheads 28 and 48 displace in a manner shown in the graphs of FIG. 7 corresponding to the cam angle θ. More specifically, as exemplified in the upper part of FIG. 10, the crosshead 28 displaces in the form of a concave-upward quadratic function, from a cam angle of θ1 at the bottom dead center BDC to a cam angle of θ1A. Further, the crosshead 28 displaces in the form of a liner function (linearly) from a cam angle of θ1A to a cam angle of θ1B, and displaces in the form of a concave-downward quadratic function, from the cam angle of θ1B to a cam angle of θ2. Then, the crosshead 28 displaces in the form of a concave-upward quadratic function from the cam angle of θ2 to a cam angle of θ3, and displaces in the form of a linear function from the cam angle of θ3 to a cam angle of θ5.

The crosshead 28 displaces in the form of a concave-downward quadratic function from the cam angle of θ5 to a cam angle of θ6, and reaches the top dead center TDC at the cam angle of θ6. From this point on, the crosshead 28 is put in the backward movement process, and the crosshead 28 moves backward while showing the waveform as shown in FIG. 7 from the cam angle of θ6 to the cam angle of θ1 at the bottom dead center.

These relationships of the displacements (strokes) of the crossheads 28 and 48 with respect to the cam angle θ can be arbitrarily set under a condition that a total flow rate of discharge flow rates Q1 and Q2 of the reciprocating pumps 20 and 40 is a constant (Q1+Q2=Const.). For example, for the displacement, in place of the form as shown in FIG. 7 which is a combination of the linear and quadratic functions, various other displacement forms may be set. In addition, the velocities of the crossheads 28 and 48 (FIG. 8) may be set in various waveforms corresponding to the displacements of the crossheads 28 and 48, respectively.

The crosshead 48 displaces with a phase difference of 180° with respect to the crosshead 28. In FIGS. 7 to 11, cam angles θ1, θ2, and θ3 are shown as having the phase difference of 180° with the cam angles θ4, θ5, and θ6, respectively (θ1+180°=θ4, θ2+180°=θ5, θ3+180°=θ6). In addition, for example, θ1=0°, θ2=30°, and θ3=60°.

With the displacements of the crossheads 28 and 48 described above, the velocities of the crossheads 28 and 48 respectively change as shown in FIG. 8. FIG. 8 shows the changes of the velocities of the crossheads 28 and 48 under the condition of the uniform rotation of the drive motor 11.

As exemplified at the upper part of FIG. 8, according to the displacement profile from θ1 to θ2 shown in FIG. 10, the velocity of the crosshead 28 changes in a trapezoidal shape from the cam angle of θ1 to the cam angle of θ2. That is, with the displacement in the form of the concave-upward quadratic function from the cam angle of θ1 to the cam angle of θ1A, the velocity V_XH1 increases in the form of a linear function with a positive slope. Further, from the cam angle of θ1A to the cam angle of θ1B, according to the displacement in the form of the linear function, the slope of the velocity V_XH1 becomes constant. Moreover, from the cam angle of θ1B to the cam angle of θ2, according to the displacement in the form of the concave-downward quadratic function, the velocity V_XH1 is decreased in the form of a linear function with a negative slope.

From the cam angle of θ2 at which V_XH1 becomes 0 to the cam angle of θ3, according to the displacement in the form of the concave-upward quadratic function, the velocity V_XH1 increases in the form of a linear function with a positive slope. Further, from the cam angle of θ3 to the cam angle of θ5, with the displacement in the form of the linear function, the slope of the velocity V_XH1 becomes constant. From the cam angle of θ5 to the cam angle of θ6, with the displacement of the concave-downward quadratic function, the velocity V_XH1 decreases in the form of a linear function with a negative slope.

With reference to FIGS. 9 and 10, from the cam angle of θ1 to the cam angle of θ2, the inner pressure P_OR1 of the hydraulic chamber 22 increases. At the cam angle of θ2, the inner pressure P_OR1 of the hydraulic chamber 22 becomes equal to the line pressure P_L, and the discharge valve 33 is switched from a closed state to an open state. With this process, the fluid (liquid) in the fluid chamber 25 is discharged to the common discharge line 36.

From this point on, with the opening of the discharge valve 33, while the inner pressure P_OR1 of the hydraulic chamber 22 is equal to the line pressure P_L, the cam angle moves as far as the cam angle of θ6 corresponding to the top dead center TDC of the crosshead 28. After the cam angle of θ6 is reached, with the backward movement of the crosshead 28, the discharge valve 33 is switched from the open state to the closed state, and the discharge of the fluid from the fluid chamber 25 to the common discharge line 36 is stopped.

Further, when the discharge valve 33 is switched from the open state to the closed state, the inner pressure P_OR1 of the hydraulic chamber 22 decreases with the backward movement of the crosshead 28. When the inner pressure P_OR1 becomes equal to the pressure of the common intake line 35, the intake valve 31 is switched from a closed state to an open state. With the further backward movement of the crosshead 28, the fluid is taken in from the common intake line 35 into the fluid chamber 25. When the cam angle reaches the cam angle of θ1 corresponding to the bottom dead center of the crosshead 28, the crosshead again transitions to the forward movement process.

With regard to a period from the cam angle of θ2 to the cam angle of θ6 at which the discharge valve 33 is set to the open state, from the cam angle of θ2 to the cam angle of θ3, with the displacement (stroke) of the crosshead 28 in the form of the concave-upward quadratic function as shown in FIG. 7, the flow rate of the fluid discharged from the fluid chamber 25 to the common discharge line 36 increases in the form of a linear function as shown by a narrow broken line of FIG. 11.

From the cam angle of θ2 to the cam angle of θ5, with the displacement of the crosshead 28 in the form of the linear function, the flow rate of the fluid discharged from the fluid chamber 25 to the common discharge line 36 becomes constant. A period from the cam angle of θ3 to the cam angle of θ5 is a single discharge step in which only the reciprocating pump 20 discharges the fluid to the common discharge line 36. Further, from the cam angle of θ5 to the cam angle of θ6, with the displacement (stroke) of the crosshead 28 in the form of the concave-downward quadratic equation, the flow rate of the fluid discharged from the fluid chamber 25 to the common discharge line 36 decreases in the form of a linear function.

In the crosshead 48 having the phase difference of 180° with respect to the crosshead 28, in a period from the cam angle of θ5 through the cam angle of θ1 to the cam angle of θ3, the discharge valve 53 is set to the open state. From the cam angle of θ5 to the cam angle of θ6, with the displacement (stroke) of the crosshead 48 in the form of the concave-upward quadratic function as shown in FIG. 7, the flow rate of the fluid discharged from the fluid chamber 45 to the common discharge line 36 increases in the form of a linear function, as shown by a thick broken line of FIG. 11.

Further, from the cam angle of θ6 through the cam angle of θ1 to the cam angle of θ2, with the displacement of the crosshead 48 in the form of the linear function, the flow rate of the fluid discharged from the fluid chamber 45 to the common discharge line 36 becomes constant. A period from the cam angle of θ6 to the cam angle of θ2 is a single discharge step in which only the reciprocating pump 40 discharges the fluid to the common discharge line 36. From the cam angle of θ2 to the cam angle of θ3, with the displacement (stroke) of the crosshead 48 in the form of the concave-downward quadratic function, the flow rate of the fluid discharged from the fluid chamber 45 to the common discharge line 36 decreases in the form of a linear function.

Here, as shown in FIG. 11, the period in which the flow rate from the fluid chamber 45 decreases from a constant state and the period in which the flow rate from the fluid chamber 25 increases to a constant state overlap each other in the period from the cam angle of θ2 to the cam angle of θ3. Similarly, the period in which the flow rate from the fluid chamber 25 decreases from a constant state and the period in which the flow rate from the fluid chamber 45 increases to a constant state overlap each other in the period from the cam angle of θ5 to the cam angle of θ6. In these periods, the fluid is supplied to the common discharge line 36 from both of the fluid chambers 25 and 45. The flow rate Q_L thereof is equal to the flow rate Q1 in a single discharge period (θ3 to θ5) in which only the reciprocating pump 20 discharges the fluid to the common discharge line 36 and in a single discharge period (θ6 to θ2) of the reciprocating pump 40. As a result, the flow rate of the common discharge line 36 is maintained at Q1 for all cam angles, and a fluid supply with no pulsation can be enabled.

The waveforms of FIGS. 7 to 11 are determined based on, for example, the line pressure P_L of the common discharge line 36. In other words, a predetermined line pressure P_L is set in advance at the design stage. Further, the shape of the rotation cam 15 is determined in advance such that the inner pressure P_OR1 of the hydraulic chamber 22 reaches the line pressure P_L at the cam angle of θ2, and the inner pressure P_OR2 of the hydraulic chamber 42 reaches the line pressure P_L at the cam angle of θ5.

In consideration of these characteristics, the cam angle θ2 which is set as the angle at which the inner pressure P_OR1 of the hydraulic chamber 22 reaches the line pressure P_L, and the cam angle θ5 which is set as the angle at which the inner pressure P_OR2 of the hydraulic chamber 42 reaches the line pressure P_L may each be called a discharge step starting point angle.

From another point of view, the periods respectively from the bottom dead centers BDC of the crossheads 28 and 48 to the points in which the inner pressures P_OR1 and P_OR2 of the hydraulic chambers 22 and 42 reach the line pressure P_L may be considered as a compression step in which the hydraulic chambers 22 and 42 are compressed. For example, in the steps of taking in the fluid from the common intake line 35 to the fluid chambers 25 and 45, the inner pressures P_OR1 and P_OR2 of the fluid chambers 25 and 45 and the hydraulic chambers 22 and 42 are respectively reduced to a pressure near atmospheric pressure. In the compression step, the inner pressures P_OR1 and P_OR2 of the fluid chambers 25 and 45 and the hydraulic chambers 22 and 42 are respectively increased to the line pressure P_L, for example, about 40 MPa.

Because the waveforms as shown in FIGS. 7 to 11 (and the shape of the rotation cam 15) are determined according to the line pressure P_L of the common discharge line 36 as described above, if the line pressure P_L deviates from the pressure (design reference value) assumed for realizing an ideal operation state as shown in FIGS. 7 to 11, the non-pulsation cannot be maintained, and a pulsation occurs.

Figure 12:
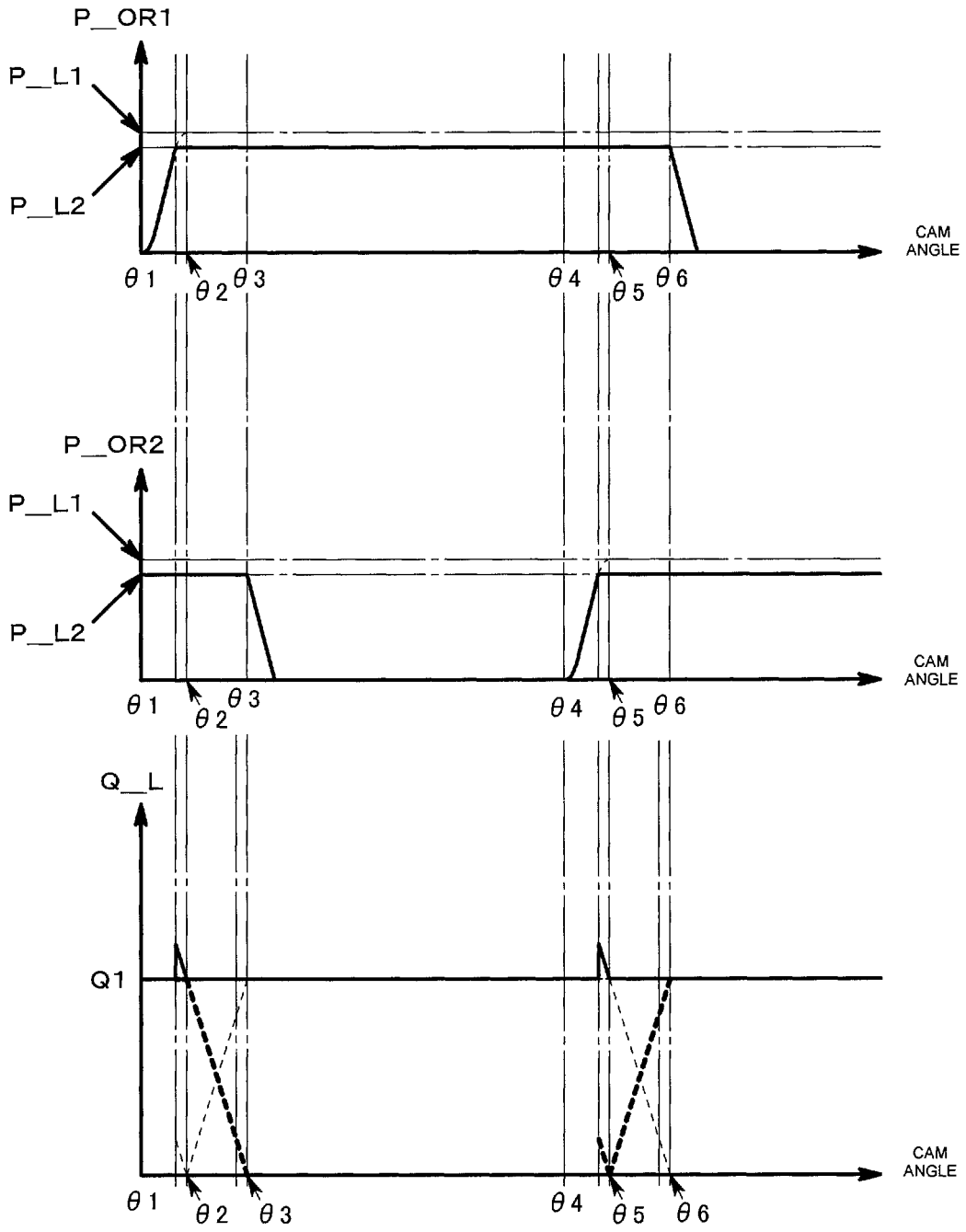
FIG. 12 is a graph for explaining a line flow rate in a non-pulsating pump according to an embodiment of the present disclosure, showing an example case in which a pulsation occurs.

For example, FIG. 12 shows a waveform when the actual line pressure P_L becomes a pressure P_L2 which is lower than the design reference value P_L1. In this example configuration, the inner pressure P_OR1 of the hydraulic chamber 22 reaches the line pressure P_L2 before the cam angle of θ2 which is the discharge step starting point angle. As a result, the fluid would be discharged from the fluid chamber 25 during a period in which the amount of discharge from the fluid chamber 45 is a constant, and a pulsation exceeding the constant flow rate Q1 occurs. In addition, a similar pulsation occurs at the cam angles of θ5 and θ6, which are respectively a phase of 180° later.

Figure 13:
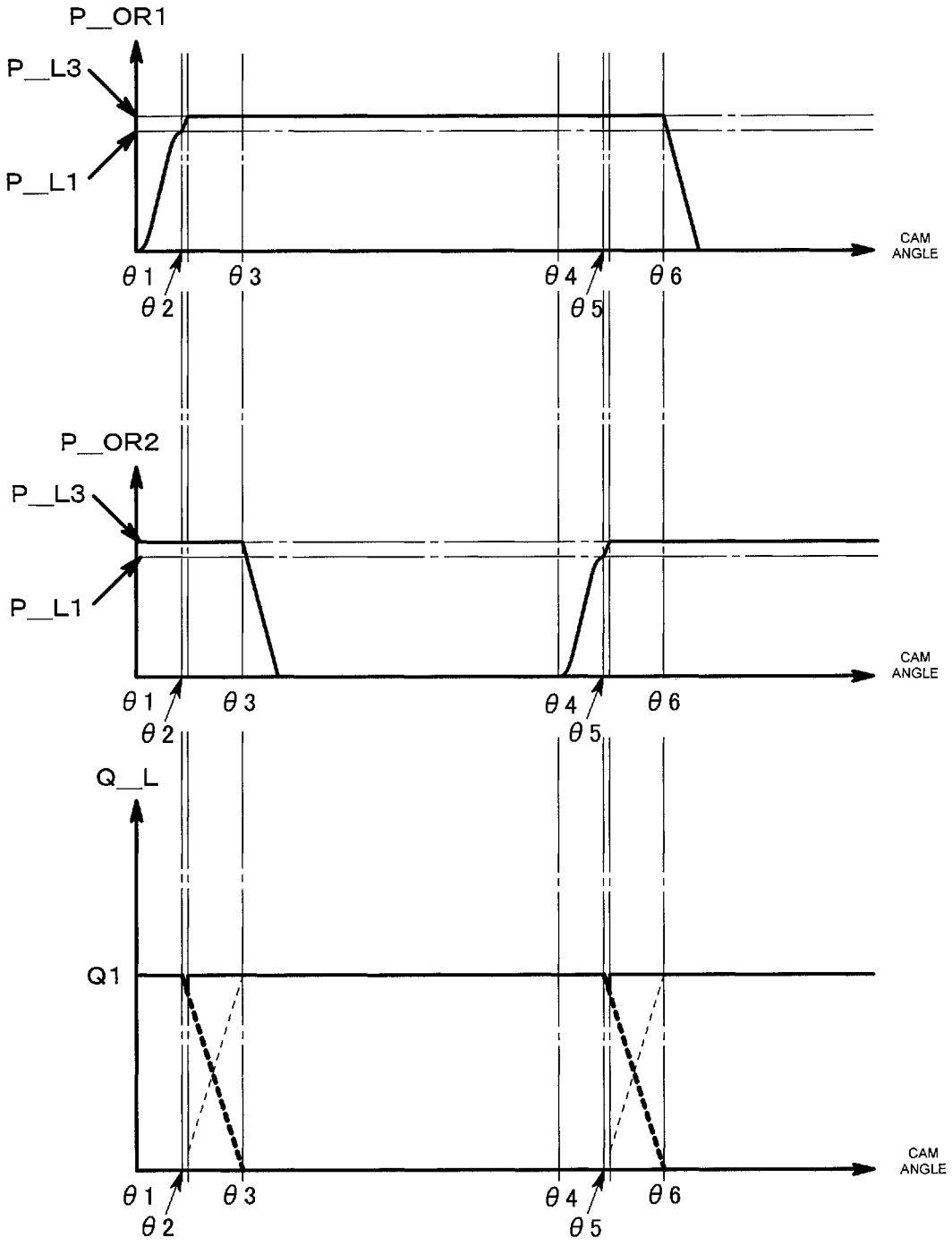
FIG. 13 is a graph for explaining a line flow rate in a non-pulsating pump according to an embodiment of the present disclosure, showing another example case in which a pulsation occurs.

FIG. 13 shows a waveform when the actual line pressure P_L becomes a pressure P_L3 which is higher than the design reference value P_L1. In this example configuration, the inner pressure P_OR1 of the hydraulic chamber 22 reaches the line pressure P_L3 after the cam angle θ2 which is the discharge step starting point angle. As a result, the discharge from the fluid chamber 25 would be started in a period in which the flow rate is gradually reduced after the period in which the discharge amount from the fluid chamber 45 is a constant, and a pulsation occurs in which the flow rate Q_L of the common discharge line 36 is less than the constant flow rate Q1. Moreover, a similar pulsation occurs at the cam angles of θ5 and θ6 which are respectively a phase of 180° later.

As described, in order to prevent occurrence of the pulsation, it is necessary to maintain the line pressure P_L at the design reference value P_L1. However, with such a configuration, it becomes impossible to apply the non-pulsating pump to various processes having different line pressures P_L. In consideration of this, in the non-pulsating pump 100 of the present embodiment, stroke adjustment control to be described later is executed, to enable prevention of the occurrence of the pulsation even when the line pressure P_L is changed.

<Stroke Adjustment Control>

Figure 14:
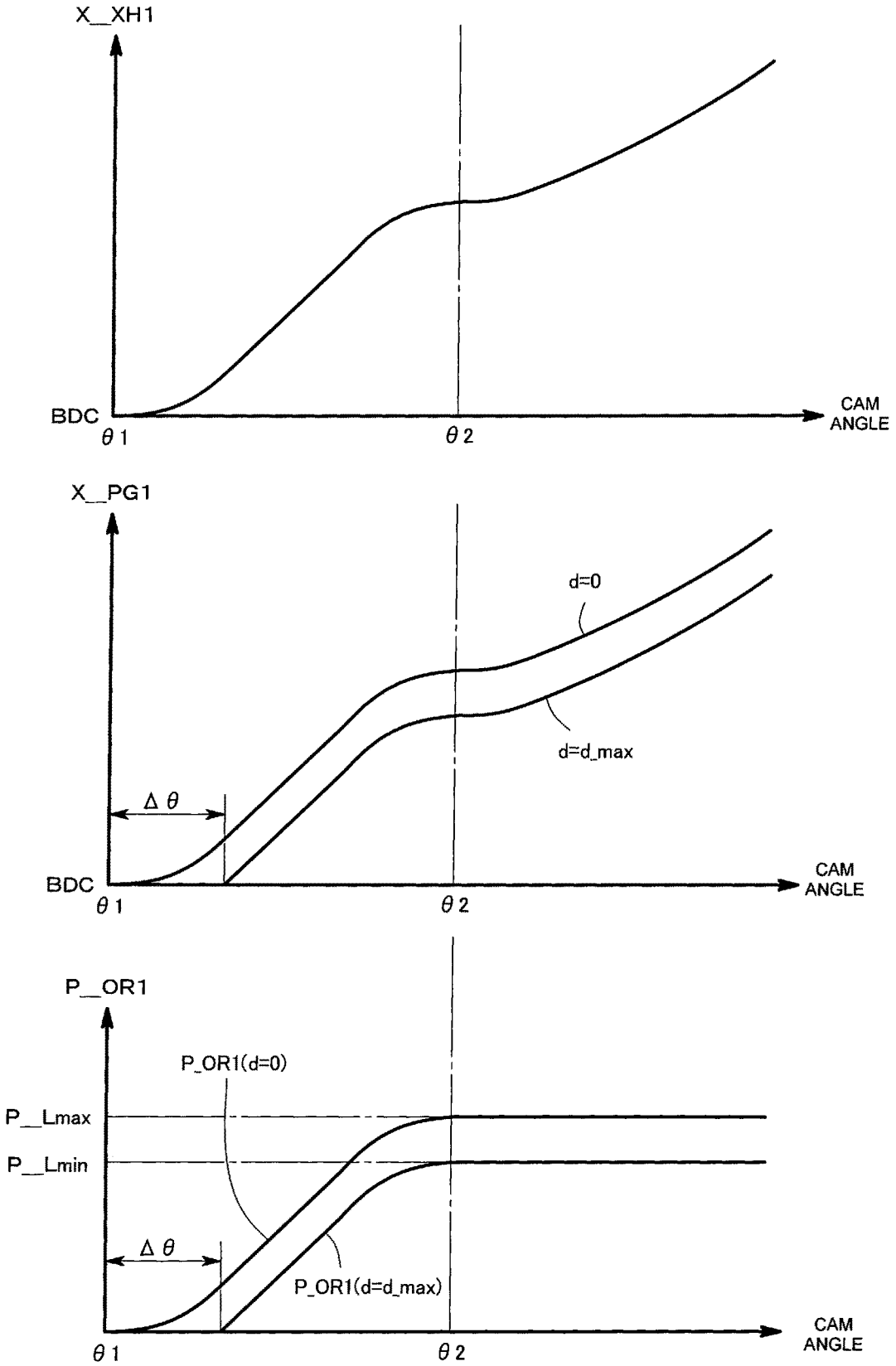
FIG. 14 is a graph for explaining control of a stroke adjustment in a non-pulsating pump according to an embodiment of the present disclosure.

FIG. 14 exemplifies a summary of the stroke adjustment control in the non-pulsating pump 100 of the present embodiment. An upper part shows a change of the position (stroke) X_XH1 of the crosshead 28 corresponding to the cam angle. A middle part shows a change of the position (stroke) X_PG1 of the plunger 26 corresponding to the cam angle. A lower part shows a change of the inner pressure P_OR1 of the hydraulic chamber 22 corresponding to the cam angle. Graphs for the crosshead 48, the plunger 46, and the hydraulic chamber 42 would be graphs having a phase difference of 180° with respect to the corresponding graphs of FIG. 14 (these graphs are not shown).

As shown at the middle part of FIG. 14, the stroke of the plunger 26 can be adjusted with respect to the crosshead 28 by the stroke adjustment mechanism 80. The graph at the middle part exemplifies a waveform of the plunger 26 when the ineffective stroke length d=0, and a waveform of the plunger 26 when the ineffective stroke length d has a maximum value, d_max. A parameter Δθ shown in the middle part is a rotational angle of the rotation cam 15 (play angle) corresponding to the ineffective stroke length d.

Further, the lower part of FIG. 14 exemplifies a waveform of the pressure P_OR1 (d=0) of the hydraulic chamber 22 when the ineffective stroke length d=0, and a waveform of the pressure P_OR1 (d=d_max) of the hydraulic chamber 22 when the ineffective stroke length d is at the maximum value of d_max.

For example, the maximum ineffective stroke length d_max is determined according to a range of a required pressure (pressure range) for the common discharge line 36 on which the non-pulsating pump 100 is installed. For example, the maximum ineffective stroke length d_max and the shape of the rotation cam 15 are determined to satisfy the following two conditions.

Condition 1: Points in time when the pressures P_OR1 (d=0) and P_OR2 (d=0) of the hydraulic chambers 22 and 42, when the ineffective stroke length d=0, respectively reach the maximum required pressure P_Lmax for the common discharge line 36 are respectively matched with the discharge step starting point angles θ2 and θ5.

Condition 2: Points in time when the pressures P_OR1 (d=d_max) and P_OR2 (d=d_max) of the hydraulic chambers 22 and 42, when the ineffective stroke length is d_max, respectively reach a minimum required pressure P_Lmin for the common discharge line 36 are respectively matched with the discharge step starting point angles θ2 and θ5.

Therefore, for example, as the minimum required pressure P_Lmin for the common discharge line 36 becomes close to 0 [MPa], a starting point of P_OR2 (d=d_max) becomes closer to the discharge step starting point angles θ2 and θ5.

In the stroke adjustment control of the present embodiment, for example, with a reduction of the line pressure P_L, the play ranges of the plungers 26 and 46, that is, the ineffective stroke lengths d, are increased, to reduce a compression step amount. As a result, times for the pressure increase of the hydraulic chambers 22 and 42 can be delayed. With this process, the points in time when the inner pressures P_OR1 and P_OR2 of the hydraulic chambers 22 and 42 respectively reach the line pressure P_L2 can be respectively matched with the discharge step starting point angles θ2 and θ5.

Figure 15:
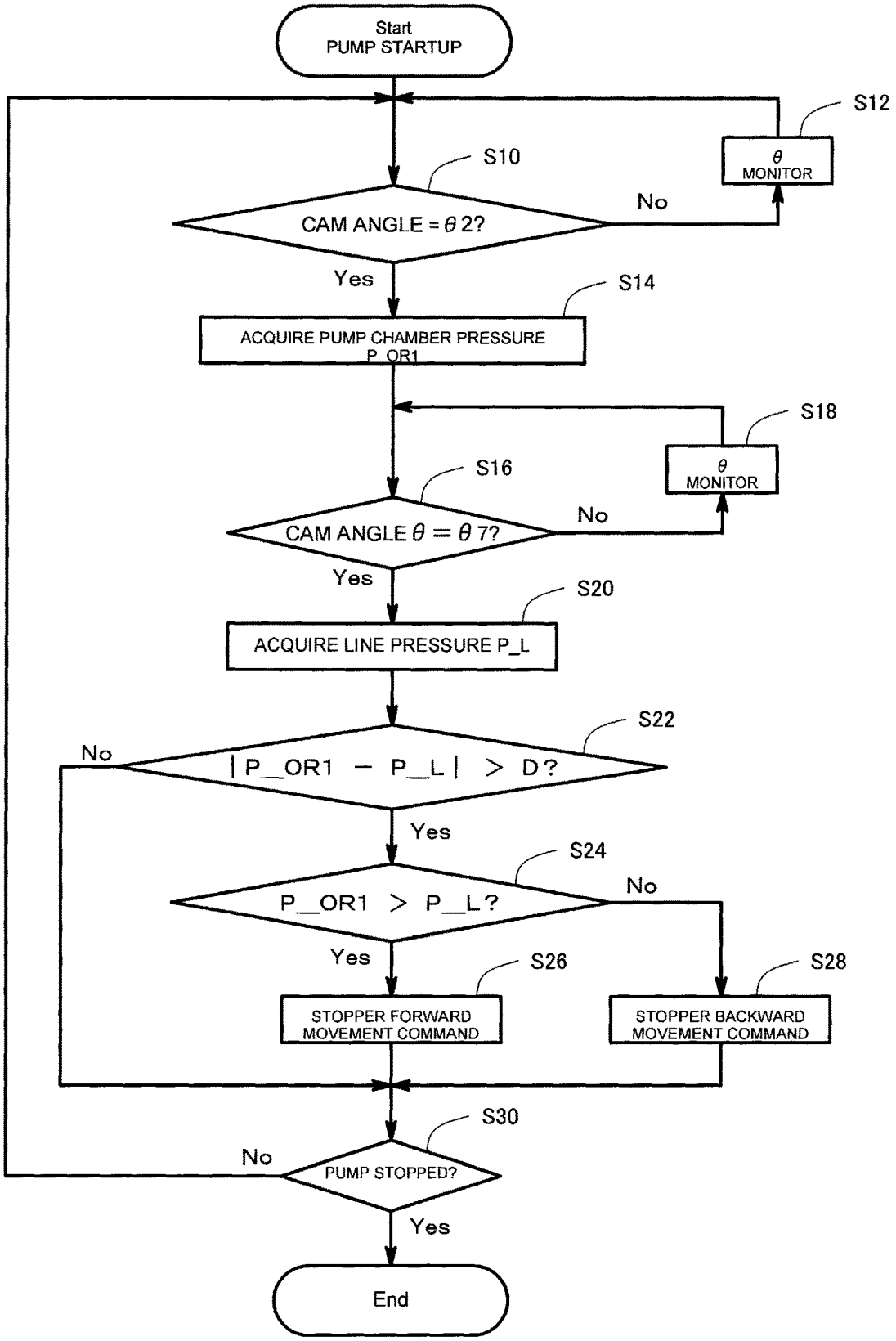
FIG. 15 is a flowchart explaining control of a stroke adjustment in a non-pulsating pump according to an embodiment of the present disclosure.

FIG. 15 exemplifies a flowchart of the stroke adjustment control by the stroke adjustment control unit 150*a* (FIG. 6). Upon reception of a startup command of the non-pulsating pump 100, the control unit 160 drives the drive motor 11 with the uniform rotation. The cam angle θ of the rotation cam 15 is sent from the rotary encoder 130 to the pump chamber pressure measurement unit 152*a* and the line pressure measurement unit 151*a*.

The pump chamber pressure measurement unit 152*a* determines whether or not the cam angle θ is the discharge step starting point angle θ2 (S10). When the cam angle θ≠θ2, the pump chamber pressure measurement unit 152*a* continues monitoring of the cam angle θ (S12). When the cam angle θ=θ2, the pump chamber pressure measurement unit 152*a* acquires the pressure P_OR1 of the hydraulic chamber 22 when the cam angle θ=θ2, from the inner pressure sensor 64 (S14).

Next, the line pressure measurement unit 151*a* determines whether or not the cam angle θ is a predetermined cam angle θ7 (θ3≤θ7≤θ5) in the single discharge steps (θ3~θ5, and θ6~θ2), while receiving the line pressure P_L (pipe pressure) from the line pressure sensor 63 (S16). For example, θ7 may be set at θ7=350°.

When the cam angle θ≠θ7, the line pressure measurement unit 151*a* continues monitoring of the cam angle θ (S18). When the cam angle θ=θ7, the line pressure measurement unit 151*a* acquires the line pressure P_L when the cam angle θ=θ7, from the line pressure sensor 63 (S20). As described above, when the discharge valve 33 is in the open state, the fluid chamber 25, the hydraulic chamber 22, and the common discharge line 36 are all at the same pressure. Therefore, the detection value P_OR1 of the inner pressure sensor 64 in this state may be set as the line pressure P_L. Similarly, the detection value P_OR2 of the inner pressure sensor 65 at the time when the discharge valve 53 is in the open state may be set as the line pressure P_L.

The pressure comparator 153*a* acquires the inner pressure P_OR1 of the hydraulic chamber 22 at the discharge step starting point angle θ2 from the pump chamber pressure measurement unit 152*a*, acquires the line pressure P_L at the single discharge step from the line pressure measurement unit 151*a*, and compares these pressures (S22). More specifically, the pressure comparator 153*a* determines an absolute value of a difference between the pressures, and determines whether or not the determined absolute value exceeds a predetermined threshold D. The threshold D is a parameter which shows an allowable limit of pulsation in the process in which the non-pulsating pump 100 is used, and is, for example, arbitrarily set according to a customer request or the like.

When |P_OR1−P_L| is less than or equal to the threshold D, the pressure comparator 153*a* sends 0 as the difference value to the plunger adjuster 154*a*. On the other hand, when |P_OR1−P_L| is greater than D, the pressure comparator 153*a* transmits the difference value, ΔP_=P_OR1−P_L, to the plunger adjuster 154*a*.

At the plunger adjuster 154*a*, the effective stroke length is adjusted according to the difference value. First, it is determined whether the difference value ΔP is positive or negative (S24). When the difference value is negative, that is, when P_OR1<P_L, it means that the inner pressure P_OR1 of the hydraulic chamber 22 at the discharge step starting point angle θ2 is lower than the line pressure P_L in the single discharge step (the pattern as shown in FIG. 13). In this case, the effective stroke length is increased (extended), that is, the ineffective stroke length d is decreased (the range of the free reciprocating motion is contracted), so that the starting time of the compression step is moved forward.

A range of the increase of the effective stroke length involved with the forward movement in time is determined based on the absolute value of the difference value. For example, the plunger adjuster 154*a* stores the waveform of the inner pressure P_OR1 of the hydraulic chamber 22 with respect to arbitrary stroke effective lengths, and the increasing range Δd of the stroke effective length, that is, a range of forward/backward movement of the stopper 82, is determined based on the difference value ΔP. Further, the plunger adjuster 154*a* creates a backward movement command (play reduction command) for the adjustment motor 120 (and the stopper 82) based on pitches of the inner thread 28*c* and the outer thread 82*d*, a gear ratio of the worm gear 121 and the worm wheel 122, or the like, and transmits the command to the adjustment motor 120 (S28). The backward movement command may be, for example, a pulse signal. With the backward movement driving of the adjustment motor 120, the stopper 82 moves backward, and the ineffective stroke length d is decreased.

Similarly, when the difference value ΔP is positive, that is, when P_OR1>P_L, it means that the inner pressure P_OR1 of the hydraulic chamber 22 at the discharge step starting point angle θ2 exceeds the line pressure P_L at the single discharge step (the pattern of FIG. 12). In this case, the effective stroke length is decreased (shortened), that is, the ineffective stroke length d is increased (the range of the free reciprocating motion is extended), so that the starting point of the compression step is delayed. In addition, a reduction range of the effective stroke length involved with the delay is determined according to the absolute value of the difference value |ΔP|. The plunger adjuster 154*a* creates a forward movement command (play increasing command) for the adjustment motor 120 (and the stopper 82), and transmits the command to the adjustment motor 120 (S26). The forward movement command may be, for example, a pulse signal. With the forward movement driving of the adjustment motor 120, the stopper 82 moves forward, and the ineffective stroke length d is increased.

After the output of the forward movement command (play increasing command)/the backward movement command (play reducing command), the control unit 160 determines whether or not a stopping command for the non-pulsating pump 100 is output (S30). When the stopping command is output, the present flow is completed, and when the stopping command is not output, the process returns to step S10.

With the change of the ineffective stroke length d (play range), the positions of the top dead center and the bottom dead center of the plunger 26 change. For example, the position of the bottom dead center of the plunger 26 when the ineffective stroke length d=0 is nearer to the drive mechanism 250 than the position of the bottom dead center of the plunger 26 when the ineffective stroke length d is the maximum ineffective stroke length d_max. Consequently, a volume of the plunger 26 entering the inside of the hydraulic chamber 22 at the bottom dead center is smaller when the ineffective stroke length d=0 in comparison to the case when the ineffective stroke length d is the maximum ineffective stroke length d_max. In compensation for this difference, the diaphragm 23 is recessed on the side of the hydraulic chamber 22 so that the hydraulic chamber 22 and the fluid chamber 25 are at the same pressure.

In the above-described example configuration, the control flow of the stroke adjustment control unit 150*a* has been described. For the stroke adjustment control unit 150*b*, a similar control flow is executed. More specifically, the discharge step starting point angle at the step S10 is changed from θ2 to θ5, and the inner pressure of the hydraulic chamber at the steps S14, S22, and S24 is changed from P_OR1 to P_OR2. Similarly, in step S16, the phase difference of 180° is added to the angle θ7 in the single discharge step.

As described, in the non-pulsating pump 100 of the present embodiment, the effective stroke length is adjusted such that the points in time when the inner pressures P_OR1 and P_OR2 of the hydraulic chambers 22 and 42 respectively reach the line pressure P_L at the predetermined angle θ7 in the single discharge step are matched to the discharge step starting point angles θ2 and θ5, respectively. With such a configuration, for example, the pulsation can be suppressed with higher precision in comparison to, for example, adjustment of the effective stroke length based on the pulsation waveform.

<Non-Pulsating Pump According to Alternative Configuration of Present Embodiment>

Figure 16:
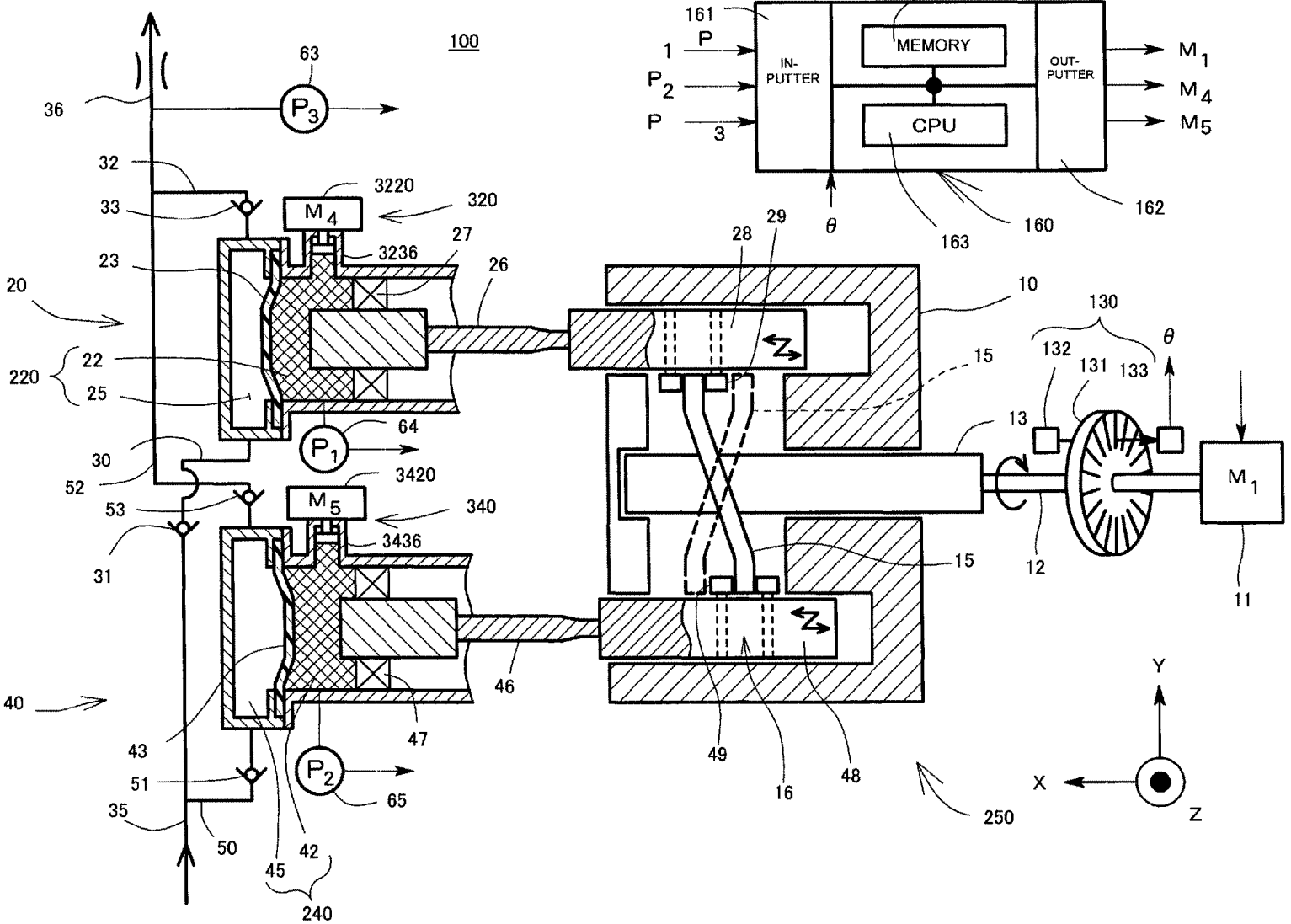
FIG. 16 is a cross sectional diagram showing a structure of a non-pulsating pump according to an alternative configuration of an embodiment of the present disclosure.

FIG. 16 exemplifies a non-pulsating pump 100 according to an alternative configuration of the present embodiment. Elements assigned the same reference numerals as those shown in FIG. 1 have basically the same structures, and will not be described again.

In the example configuration of FIG. 16, the stroke adjustment mechanism 80 is removed, and the crossheads 28 and 48 are respectively coupled directly to the plungers 26 and 46. Therefore, theoretically, no ineffective stroke length is created, and the stroke of the crosshead 28=the stroke of the plunger 26.

In addition, hydraulic pressure adjustment mechanisms 320 and 340 (inner pressure adjustment mechanisms) are provided respectively in the hydraulic chambers 22 and 42. As will be described later, the hydraulic pressure adjustment mechanism 320 and 340 can adjust the inner pressures of the pump chambers 220 and 240, respectively. That is, the hydraulic pressure adjustment mechanisms 320 and 340 can adjust times of increases of the inner pressures of the hydraulic chambers 22 and 42, respectively. More specifically, as will be described later, the inner pressures P_OR1 and P_OR2 of the hydraulic chambers 22 and 42 are adjusted so that points in time when the inner pressures P_OR1 and P_OR2 of the hydraulic chambers 22 and 42 respectively reach the line pressure P_L at the predetermined angle θ7 in the single discharge step are matched to the discharge step starting point angles θ2 and θ5, respectively. Because the times of the increases of the inner pressures are adjusted, the hydraulic pressure adjustment mechanisms 320 and 340 may also be called compression amount adjustment mechanisms.

For the purpose of illustration, in FIG. 16, the hydraulic pressure adjustment mechanisms 320 and 340 are attached at sides of the reciprocating pumps 20 and 40, but the form of attachment is not limited to this form. For example, the hydraulic pressure adjustment mechanisms 320 and 340 may be attached above the reciprocating pumps 20 and 40. With such a configuration, it becomes easier for air in the reciprocating pumps 20 and 40 to enter the hydraulic pressure adjustment mechanisms 320 and 340, and consequently, a degassing mechanism (not shown) may be provided in parallel to the hydraulic pressure adjustment mechanisms 320 and 340. In consideration of this configuration, in FIG. 17, an example configuration is shown in which the hydraulic pressure adjustment mechanisms 320 and 340 are attached above the reciprocating pumps 20 and 40.

Figure 17:
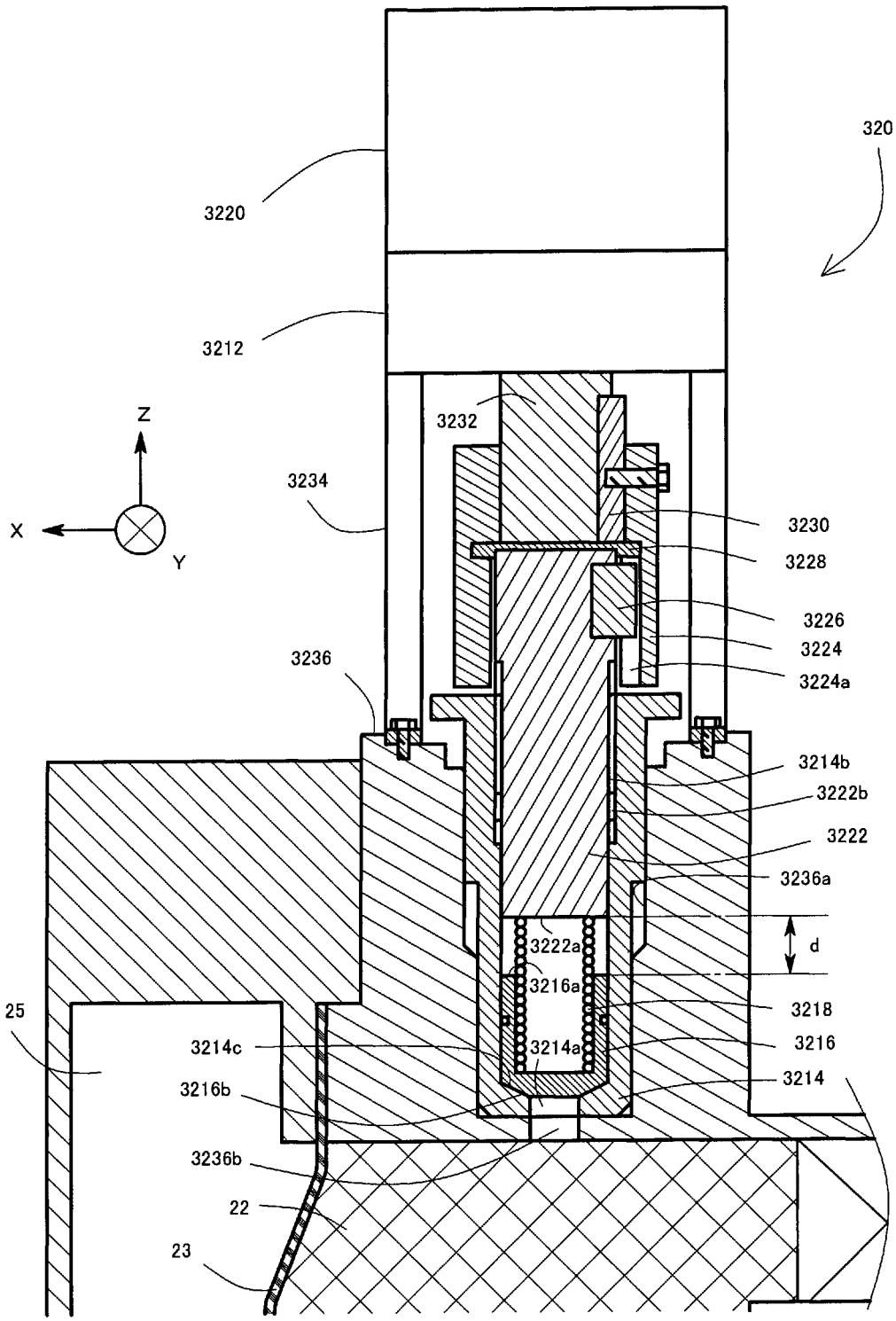
FIG. 17 is a cross sectional diagram showing a structure of a hydraulic chamber inner pressure adjustment mechanism of a non-pulsating pump in an alternative configuration of an embodiment of the present disclosure.

FIG. 17 exemplifies a side cross sectional diagram of the hydraulic pressure adjustment mechanism 320. The hydraulic pressure adjustment mechanism 320 comprises an adapter 3214, a piston 3216, a coil spring 3218, a screw 3222, a coupling 3224, a drive shaft 3232, a decelerator 3212, and an adjustment motor 3220.

The hydraulic pressure adjustment mechanism 340 on the side of the reciprocating pump 40 has a similar structure to the hydraulic pressure adjustment mechanism 320. More specifically, in the following description, the number "2" at the hundreds digit position may be replaced with "4" in the reference numerals of the elements, to describe the structure of the hydraulic pressure adjustment mechanism 340 on the side of the reciprocating pump 40.

The hydraulic pressure adjustment mechanism 320 is attached above a hydraulic chamber case 3236 which is a member partitioning the hydraulic chamber 22. Specifically, an upper part of the hydraulic chamber case 3236 has a U shape cross section, and an attachment hole 3236*a* formed in an up-and-down direction (Z axis direction) is formed for receiving the adapter 3214, the piston 3216, the screw 3222, and the like. At a bottom of the attachment hole 3236*a*, an opening 3236*b* is formed in communication with the hydraulic chamber 22.

The adapter 3214 is a cap member having a cross section of a U shape, and is fixed in the attachment hole 3236*a* of the hydraulic chamber case 3236. For example, an outer thread is formed on an outer circumferential surface of the adapter 3214, and an inner thread is formed on an inner circumferential surface of the attachment hole 3236*a*. The threads are screwed together, so that the adapter 3214 is fixed in the attachment hole 3236*a*.

An opening 3214*a* in communication with the opening 3236*b* of the hydraulic chamber case 3236 is formed to penetrate through a lower end (bottom) of the adapter 3214 in the up-and-down direction. Thus, the oil in the hydraulic chamber 22 can flow into the adapter 3214.

The piston 3216 is housed at an inner bottom of the adapter 3214. The piston 3216 has, for example, a U shape cross section, and the coil spring 3218 is inserted inside the piston 3216. The piston 3216 is pushed upward by the oil flowing in from the hydraulic chamber 22. In order to secure sealing property between the piston 3216 and the adapter 3214, a sealing member such as an O ring may be sandwiched between an outer circumferential surface of the piston and an inner circumferential surface of the adapter 3214.

A lower end of the coil spring 3218 abuts an inner bottom of the piston 3216, and an upper end of the coil spring 3218 abuts a lower end surface 3222*a* of the screw 3222. When the oil flows from the hydraulic chamber 22 into the adapter 3214, the piston 3216 is urged downward by the elastic force of the coil spring 3218, and prevents intrusion of the oil above the opening 3214*a* of the adapter 3214. On the other hand, when the inner pressure P_OR1 of the hydraulic chamber 22 increases and reaches a pressure greater than or equal to the elastic pressure of the coil spring 3218, the coil spring 3218 contracts and the piston 3216 moves backward (upward). As will be described later, a movement range of the piston 3216, that is, the stroke length d, is changed, to adjust the inner pressure (at the time of increasing the inner pressure) of the hydraulic chamber 22.

The screw 3222 has an approximately circular column shape, and is housed in the adapter 3214. An outer thread 3222*b* is formed on the outer circumferential surface of the adapter 3214, and is screwed into the inner thread 3214*b* formed on the inner circumferential surface of the adapter 3214. When the screw 3222 rotates with the screwing of the outer thread 3222*b* and the inner thread 3214*b*, the screw 3222 moves forward and backward in the up-and-down direction with respect to the adapter 3214.

With the forward/backward movement in the up-and-down direction, the stroke length d of the piston 3216 is adjusted.

A rotational drive force is transmitted to the screw 3222 from the adjustment motor 3220. More specifically, the rotational drive force is transmitted from the adjustment motor 3220 through the decelerator 3212, the drive shaft 3232, a key 3230, the coupling 3224, and a key 3226, to the screw 3222. The adjustment motor 3220 is formed from, for example, a reversible motor.

The drive shaft 3232 is provided at a lower end of the decelerator 3212, and is placed to be coaxial with the screw 3222. A stopper 3228, for example, is provided between a lower end of the drive shaft 3232 and the screw 3222. The stopper 3228 determines a maximum elevation point of the screw 3222, and abuts an upper end of the screw 3222 moving upward.

The drive shaft 3232 is connected to the coupling 3224 via the key 3230. The coupling 3224 is a circular tubular member provided at an outer circumference of the drive shaft 3232 and the screw 3222, and rotates with the drive shaft 3232.

A key groove 3224*a* which is formed in the up-and-down direction is formed on an inner circumferential surface of the coupling 3224. The key 32226 is slidable in the key groove 3224*a*. The key 3226 is fixed on the screw 3222, and protrudes in an outer side in a radial direction, and the protruding portion is fitted in the key groove 3224*a* in a slidable manner.

Thus, while the screw 3222 can relatively move in the up-and-down direction with respect to the coupling 3224, with regard to the rotational direction, the screw 3222 rotates with the coupling 3224 due to the fitted relationship of the key groove 3224*a* and the key 3226.

With reference to FIGS. 16 and 17, with the forward movements of the crosshead 28 and the plunger 26, the inner pressure P_OR1 of the hydraulic chamber 22 increases. With the increase of the inner pressure P_OR1, the pressure (inner pressure) received by the lower surface (front surface) of the piston 3216 of the hydraulic pressure adjustment mechanism 320 increases. When this inner pressure exceeds the elastic pressure of the coil spring 3218, the coil spring 3218 is contracted, and the piston 3216 is moved upward. During this process, the stroke length d is shortened.

When the stroke length d becomes 0 and the upper end surface 3216*a* of the piston 3216 abuts the lower end surface 3222*a* of the screw 3222, the upward movement of the piston 3216 stops, and the inner pressure P_OR1 of the hydraulic chamber 22 continues to increase.

After the crosshead 28 reaches the top dead center, the crosshead 28 moves backward, and the inner pressure P_OR1 of the hydraulic chamber 22 decreases. In this process, the coil spring 3218 urges the piston 3216 downward. With the urging, the lower end surface 3216*b* of the piston 3216 abuts a bottom surface 3214*c* at an inner side of the adapter 3214. With this process, the stroke length d is secured. After the crosshead 28 reaches the bottom dead center, that is, a point farthest away from the pump chamber 220, the crosshead 28 again moves forward.

Figure 18:
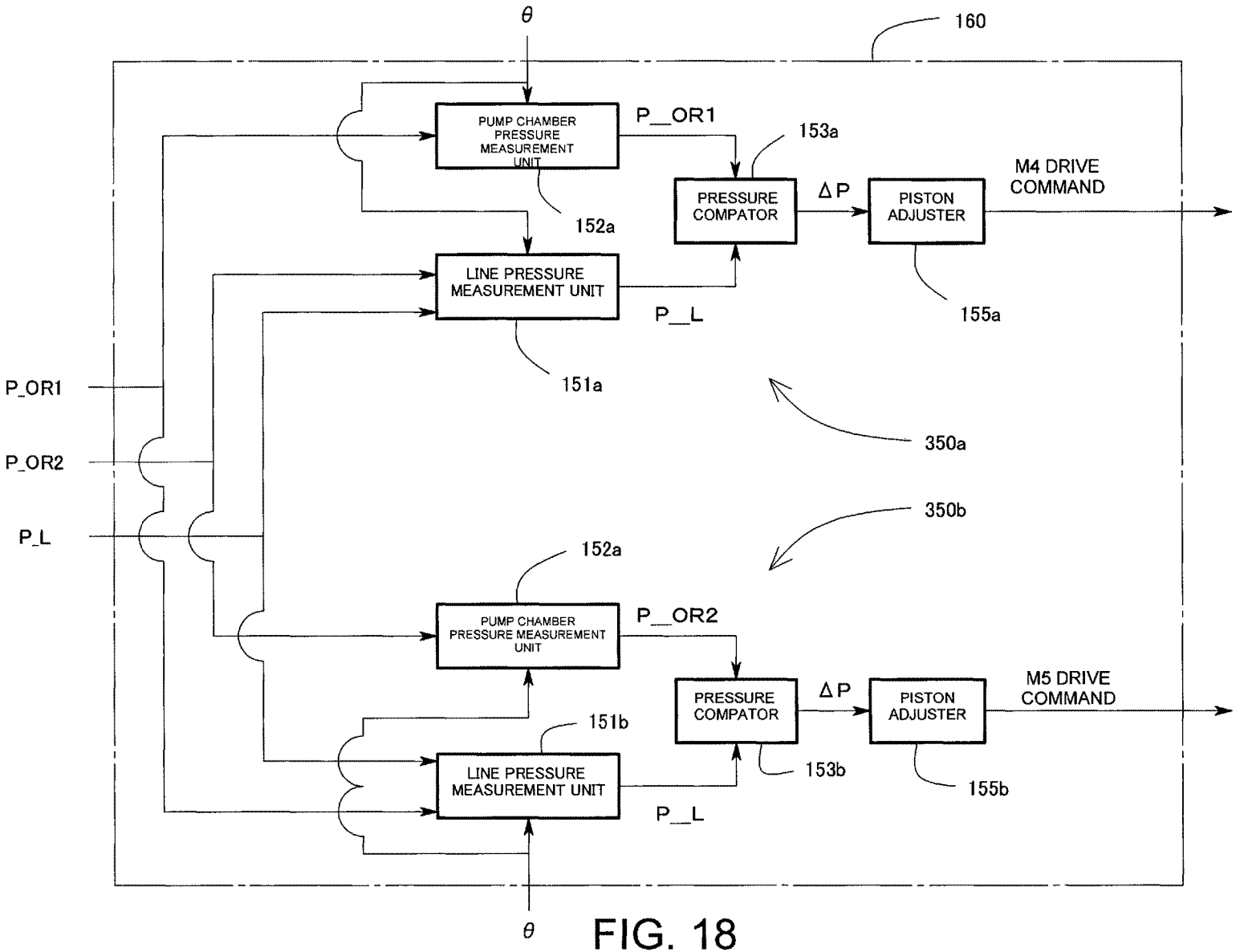
FIG. 18 is a diagram for explaining a block structure of a control unit of a non-pulsating pump in an alternative configuration of an embodiment of the present disclosure.

FIG. 18 exemplifies functional blocks of the control unit 160 for executing the pump chamber inner pressure adjustment control of the present embodiment. FIG. 18 differs from FIG. 6 in that pump chamber inner pressure adjustment control units 350*a* and 350*b* are provided in place of the stroke adjustment control units 150*a* and 150*b*. In addition, piston adjusters 155*a* and 155*b* are provided in place of the plunger adjusters 154*a* and 154*b*.

<Pump Chamber Inner Pressure Adjustment Control>

Figure 19:
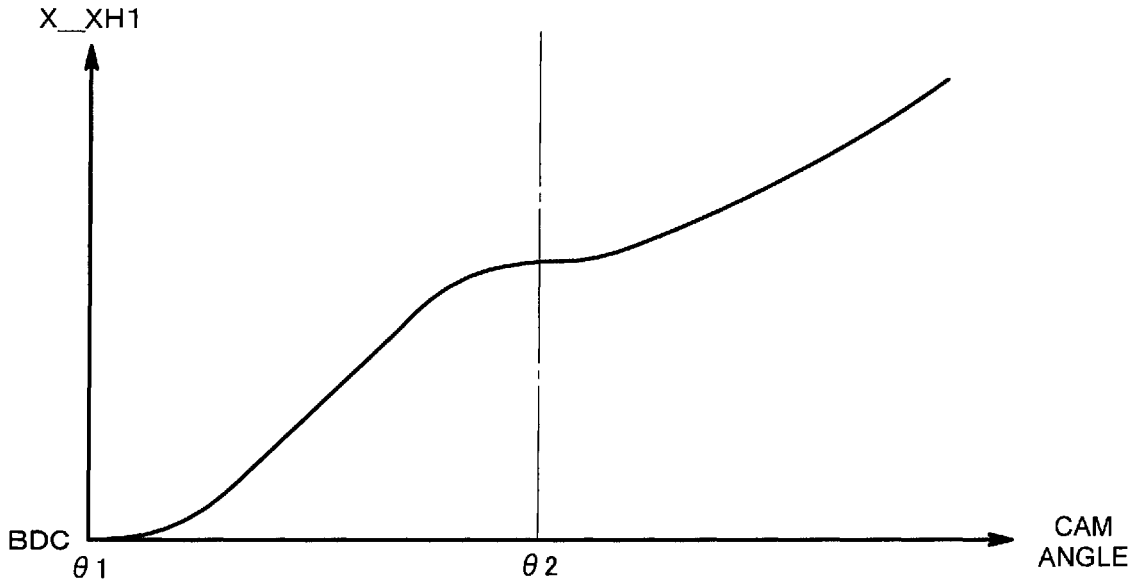
FIG. 19 is a graph for explaining control of an inner pressure adjustment in a non-pulsating pump in an alternative configuration of an embodiment of the present disclosure.
Figure 19:
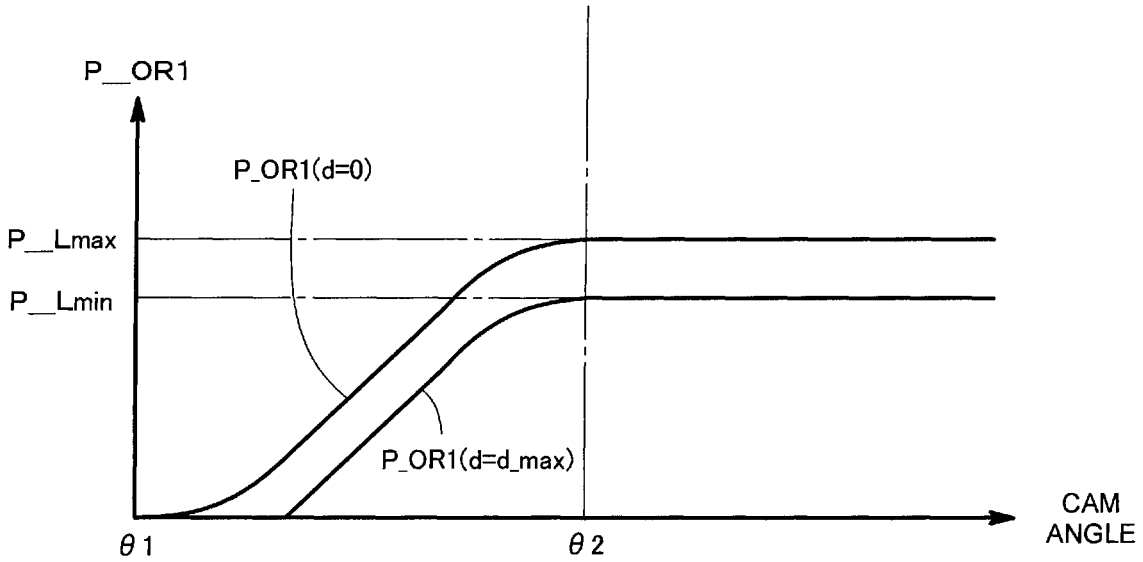
Figure 20:
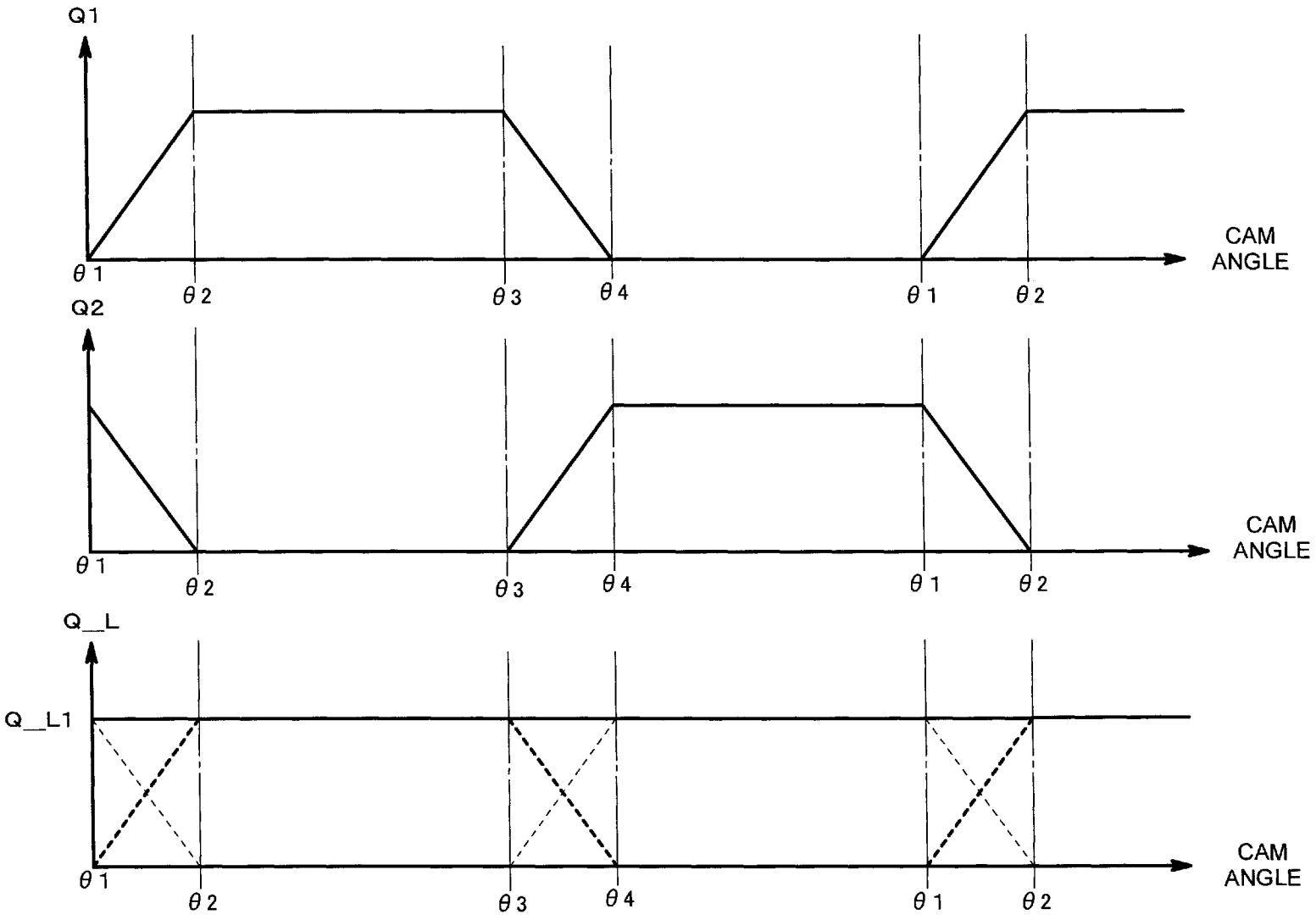
FIG. 20 is a graph for explaining an operation of a non-pulsating pump.
Figure 21:
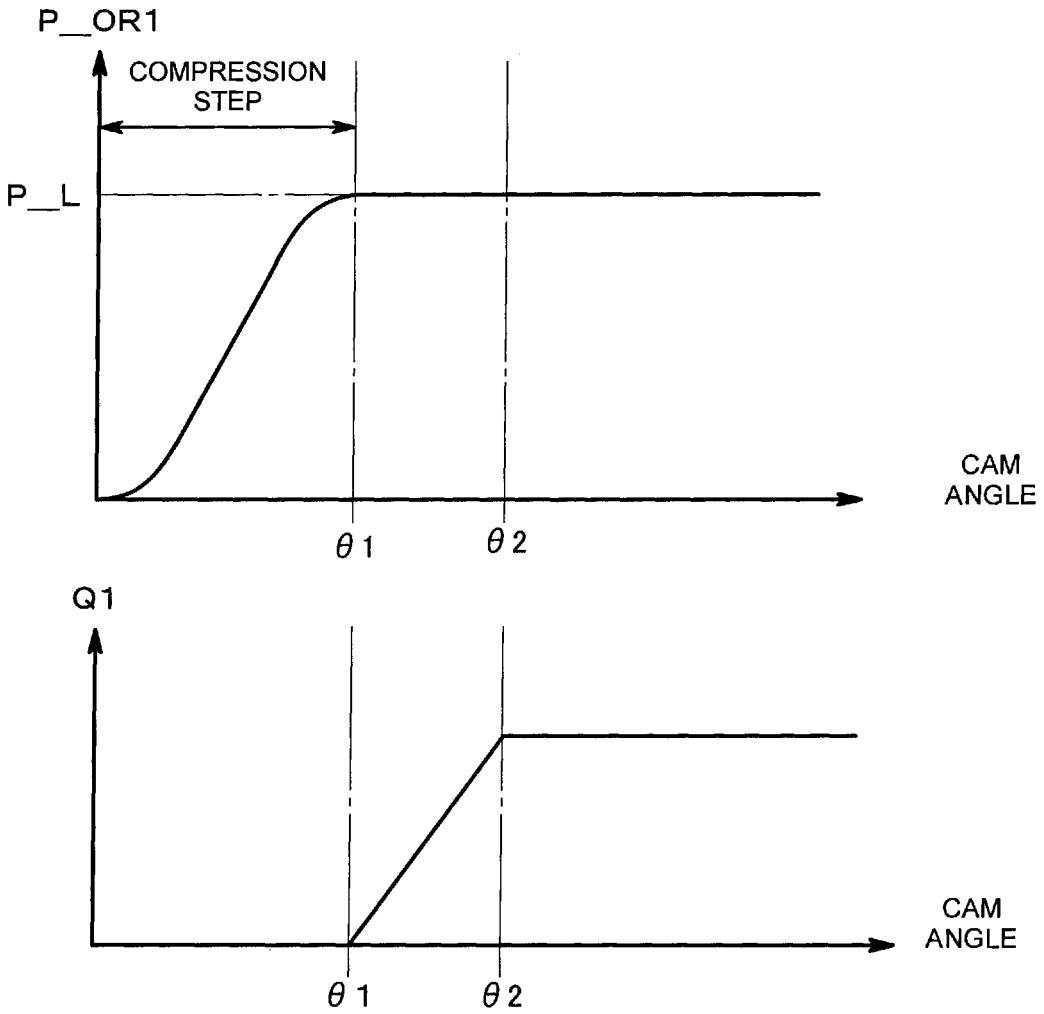
FIG. 21 is a graph for explaining a compression step.
Figure 22:
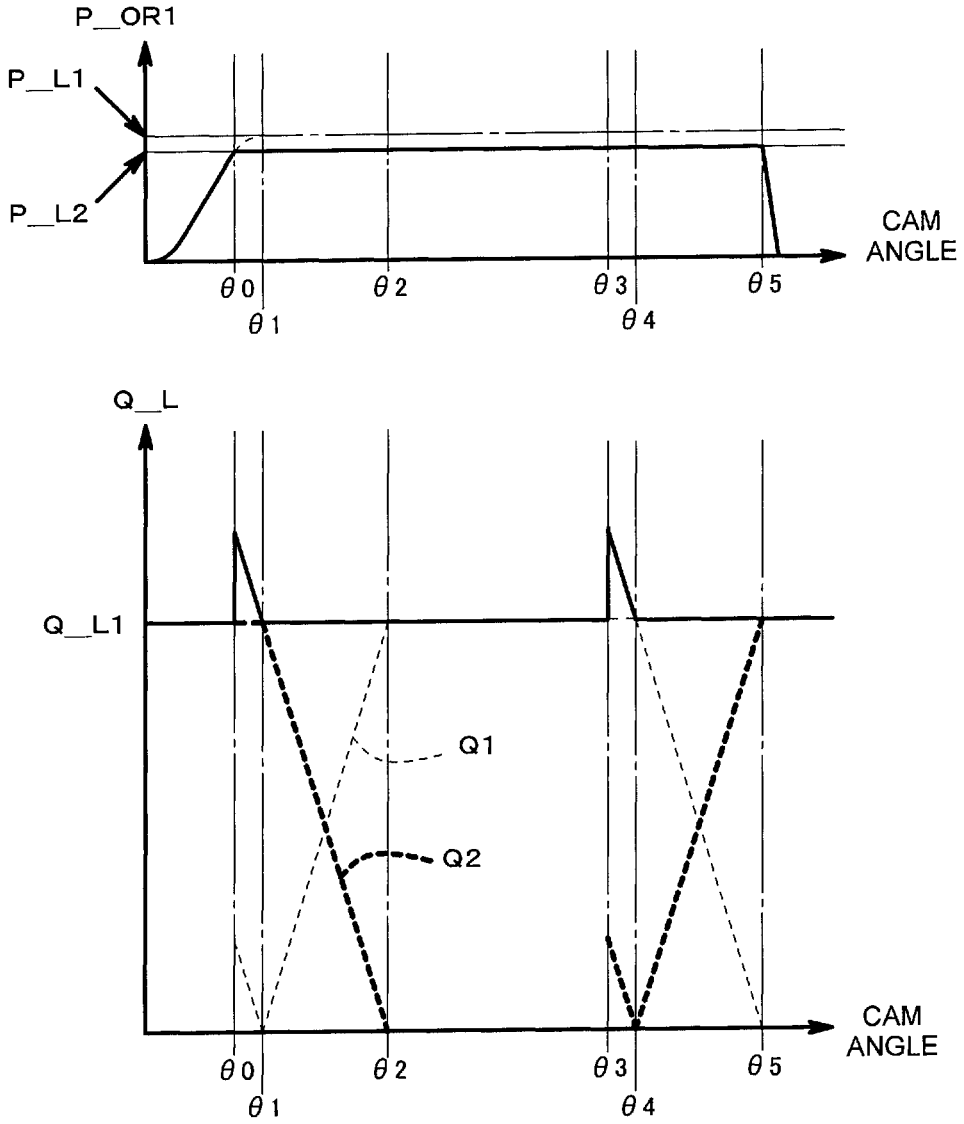
FIG. 22 is a graph for explaining a line flow rate in a non-pulsating pump of related art, and explaining an example case in which a pulsation occurs.
Figure 23:
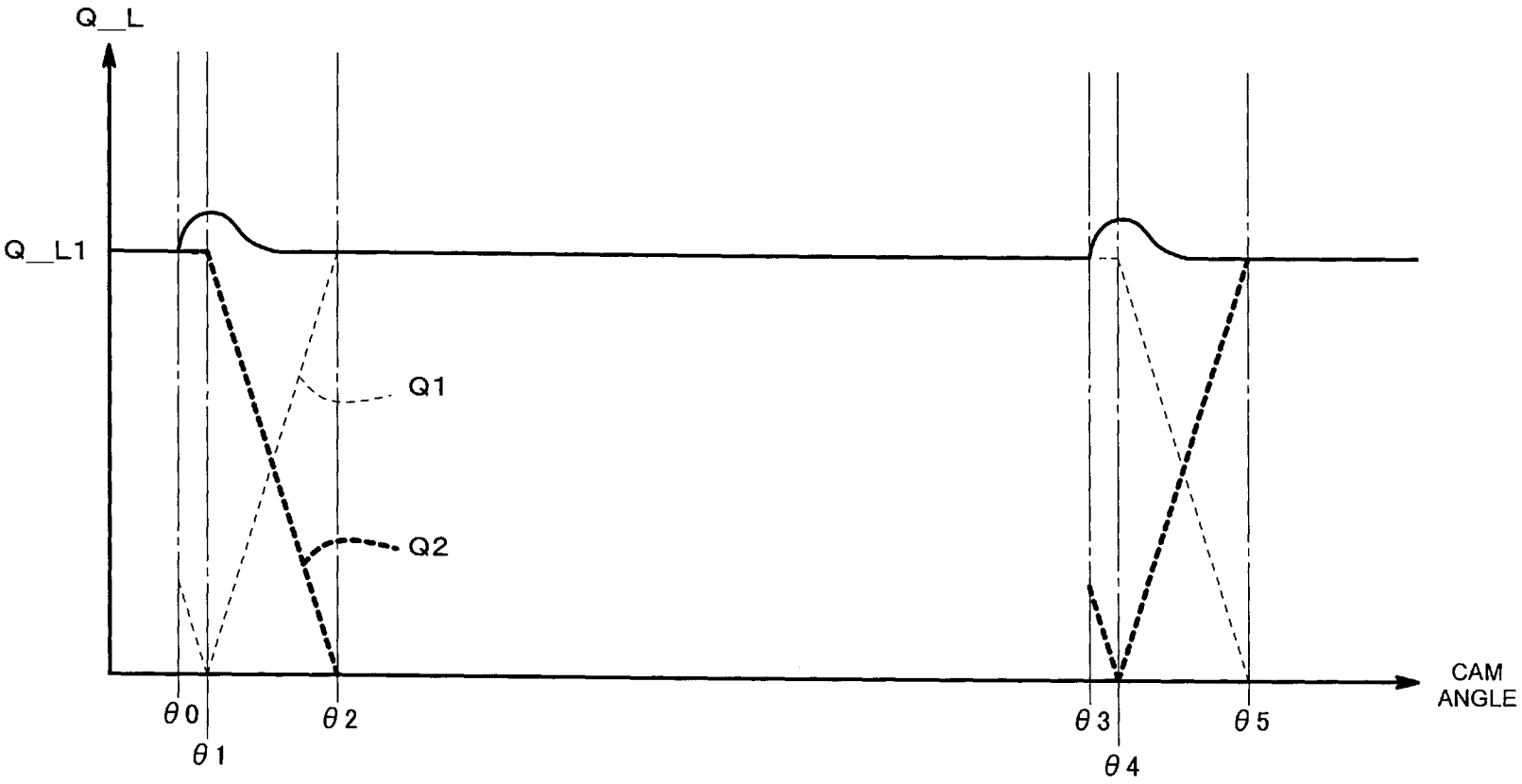
FIG. 23 is a graph for explaining a line flow rate in a non-pulsating pump of the related art, and exemplifying an actual pulsation waveform when a pulsation occurs.

FIG. 19 exemplifies a summary of the pump chamber inner pressure adjustment control in the non-pulsating pump 100 of the present embodiment. In the following, control of the pump chamber inner pressure adjustment control unit 350*a* will be described. An upper part of FIG. 19 shows a change of the position (stroke) X_XH1 of the crosshead 28 corresponding to the cam angle. A lower part of FIG. 19 shows a change of the inner pressure P_OR1 of the hydraulic chamber 22 corresponding to the cam angle. The crosshead 48, the plunger 46, and the hydraulic chamber 42 would have graphs (which will not be shown) having a phase difference of 180° with respect to the graphs of FIG. 19.

With reference to the lower part of FIG. 19, a waveform of the pressure P_OR1 (d=0) of the hydraulic chamber 22 when the stroke length d of the piston 3216 is 0, and a waveform of the pressure P_OR1 (d=d_max) of the hydraulic chamber 22 when the stroke length d of the piston 3216 is the maximum value, d_max, are exemplified.

For example, the maximum stroke length d_max is determined according to a range of a required pressure (pressure range) for the common discharge line 36 on which the non-pulsating pump 100 is installed. For example, the maximum stroke length d_max and the shape of the rotation cam 15 are determined to satisfy the following two conditions.

Condition 1: Points in time when the pressures P_OR1 (d=0) and P_OR2 (d=0) of the hydraulic chambers 22 and 42, respectively, when the stroke length d=0 reach the maximum required pressure P_Lmax for the common discharge line 36 are matched with the discharge step starting point angles θ2 and θ5, respectively.

Condition 2: Points in time when the pressures P_OR1 (d=d_max) and P_OR2 (d=d_max) of the hydraulic chambers 22 and 42, respectively, when the stroke length d is at the maximum stroke length d_max, reach the minimum required pressure P_Lmin for the common discharge line 36 are matched with the discharge step starting point angles θ2 and θ5, respectively.

In the pump chamber inner pressure adjustment control of the present embodiment, for example, with a reduction of the line pressure P_L, the stroke length d of the piston 3216 is increased, to reduce the compression step amount. As a result, the times when pressures of the hydraulic chambers 22 and 42 are increased are delayed. With this process, it becomes possible to match the points in time when the inner pressures P_OR1 and P_OR2 of the hydraulic chambers 22 and 42 reach the line pressure P_L2 with the discharge step starting point angles θ2 and θ5.

A flowchart of the pump chamber inner pressure adjustment control by the control unit 160 is identical to the flowchart of FIG. 15 showing the stroke adjustment control, except that, in steps S26 and S28, the piston adjusters 155*a* and 155*b* respectively output a forward movement command (play increasing command) and a backward movement command (play decreasing command) to the adjustment motors 3220 and 3420, respectively.

More specifically, in the piston adjuster 155*a*, the stroke length d of the piston 3216 is adjusted corresponding to a difference value. First, in step S24, it is determined whether the difference value ΔP is positive or negative. When the difference value is negative, that is, P_OR1<P_L, the inner pressure P_OR1 of the hydraulic chamber 22 at the discharge step starting point angle θ2 is lower than the line pressure P_L at the single discharge step. In this case, the stroke length d is decreased (the range of the free reciprocating motion is reduced), so as to move the starting point of the compression step forward.

An increase range of the stroke length involved with the forward movement in time is determined according to the absolute value of the difference value. For example, the piston adjuster 155*a* stores a waveform of the inner pressure P_OR1 of the hydraulic chamber 22 corresponding to an arbitrary stroke length, and the increase range Δd of the stroke length, that is, a forward/backward movement range of the screw 3222, is determined based on the difference value ΔP. Further, the piston adjuster 155*a* creates the backward movement command (play decreasing command) for the adjustment motor 3220 (and the screw 3222) based on pitches of the inner thread 3214*b* and the outer thread 3222*b*, the deceleration ratio of the decelerator 3212, or the like, and transmits the command to the adjustment motor 3220 (S28). With the backward movement driving of the adjustment motor 3220, the screw 3222 moves backward, and the stroke length d is decreased.

Similarly, when the difference value ΔP is positive, that is, P_OR1>P_L, the inner pressure P_OR1 of the hydraulic chamber 22 at the discharge step starting point angle θ2 exceeds the line pressure P_L in the single discharge step. In this case, the stroke length d is increased (the range of the free reciprocating motion is extended), to delay the starting point of the compression step. The reduction range of the stroke length involved with the delay is determined according to the absolute value |ΔP| of the difference value. The piston adjuster 155*a* creates a forward movement command (play increasing command) for the adjustment motor 3220 (and the screw 3222), and transmits the command to the adjustment motor 3220 (S26). The forward movement command may be, for example, a pulse signal. With the forward movement driving of the adjustment motor 3220, the screw 3222 moves forward and the stroke length d increases.

In the above, the control flow of the pump chamber inner pressure adjustment control unit 350*a* is described. A similar control flow is executed for the pump chamber inner pressure adjustment control unit 350*b*. More specifically, in step S10, the discharge step starting point angle θ2 becomes θ5, and, in steps S14, S22, and S24, the inner pressure P_OR1 of the hydraulic chamber is replaced with P_OR2. Similarly, in step S16, a phase difference of 180° is added to the angle θ7 in the single discharge step.

As described, in the non-pulsating pump 100 of the present embodiment, the stroke length d of the piston 3216 is adjusted such that the points in time when the inner pressures P_OR1 and P_OR2 of the hydraulic chambers 22 and 42, respectively, reach the line pressure P_L at the predetermined angle θ7 in the single discharge step are the discharge step starting point angles θ2 and θ5, respectively. With such a configuration, the pulsation can be suppressed with a higher precision in comparison to a case in which the stroke length is adjusted, for example, based on a pulsation waveform.

REFERENCE SIGNS LIST

11 DRIVE MOTOR; 15 ROTATION CAM; 16 CAM MECHANISM; 20, 40 RECIPROCATING PUMP; 22, 42 HYDRAULIC CHAMBER; 23, 43 DIAPHRAGM; 25, 45 FLUID CHAMBER; 26, 46 PLUNGER; 28, 48 CROSSHEAD; 31, 51 INTAKE VALVE; 33, 53 DISCHARGE VALVE; 35 COMMON INTAKE LINE; 36 COMMON DISCHARGE LINE; 63 LINE PRESSURE SENSOR; 64, 65 INNER PRESSURE SENSOR; 80 STROKE ADJUSTMENT MECHANISM; 82 STOPPER; 83 REINFORCEMENT MEMBER; 84 COIL SPRING; 100 NON-PULSATING PUMP; 120, 140, 3220, 3420 ADJUSTMENT MOTOR; 121, 141 WORM GEAR; 122, 142 WORM WHEEL; 130 ROTARY ENCODER; 150*a*, 150*b* STROKE ADJUSTMENT CONTROL UNIT; 151*a*, 151*b* LINE PRESSURE MEASUREMENT UNIT; 152*a*, 152*b* PUMP CHAMBER PRESSURE MEASUREMENT UNIT; 153*a*, 153*b* PRESSURE COMPARATOR; 154*a*, 154*b* PLUNGER ADJUSTER; 155*a*, 155*b* PISTON ADJUSTER; 160 CONTROL UNIT; 220, 240 PUMP CHAMBER; 250 DRIVE MECHANISM; 320, 340 HYDRAULIC PRESSURE ADJUSTMENT MECHANISM; 3216, 3416 PISTON; 350*a*, 350*b* PUMP CHAMBER INNER PRESSURE ADJUSTMENT CONTROL UNIT.

The invention claimed is:

1. A non-pulsating pump comprising:

a drive mechanism having: a cam mechanism which converts a rotational motion of a drive motor into a reciprocating motion; and a plurality of crossheads which are reciprocated by the cam mechanism with a predetermined phase difference;

a plurality of reciprocating pumps, each having: a plunger which is connected to the crosshead and which reciprocates with the reciprocating motion of the crosshead; a pump chamber having an inner pressure which changes with the reciprocating motion of the plunger; an intake valve which connects a common intake line and the pump chamber, the intake valve having a side of the pump chamber as a back pressure side; and a discharge valve which connects the pump chamber and a common discharge line, the discharge valve having a side of the common discharge line as a back pressure side; and a stroke adjustment mechanism that adjusts an effective stroke length for the crosshead to reciprocate the plunger; wherein when a line pressure of the common discharge line at a single discharge step in which only one reciprocating pump, among the plurality of reciprocating pumps, acquire, discharges fluid to the common discharge line differs from the inner pressure of the pump chamber of the one reciprocating pump at a discharge step starting point angle determined corresponding to a cam angle of the cam mechanism with respect to the one reciprocating pump, the stroke adjustment mechanism adjusts the effective stroke length of the respective crosshead connected to the plunger of the one reciprocating pump based on the pressure difference such that the inner pressure of the pump chamber reaches the line pressure at the discharge step starting point angle.

2. The non-pulsating pump according to claim 1, wherein the stroke adjustment mechanism connects the plunger of the one reciprocating pump to the respective crosshead so as to enable a free reciprocating motion along a reciprocating motion direction of the respective crosshead, and the effective stroke length of the respective crosshead is adjusted by adjusting a range of the free reciprocating motion.

3. The non-pulsating pump according to claim 2, wherein the stroke adjustment mechanism comprises a stopper which determines a range of the free reciprocating motion of the plunger of the one reciprocating pump, and an adjustment motor which moves the stopper forward and backward along the reciprocating motion direction of the respective crosshead, and a forward/backward movement range of the stopper by the adjustment motor is determined based on a difference between the inner pressure of the pump chamber of the one reciprocating pump at the discharge step starting point angle and the line pressure at the single discharge step.

4. A non-pulsating pump comprising:

a drive mechanism having: a cam mechanism which converts a rotational motion of a drive motor into a reciprocating motion; and a plurality of crossheads which are reciprocated by the cam mechanism with a predetermined phase difference; and a plurality of reciprocating pumps, each having: a plunger which is connected to the crosshead and which reciprocates with the reciprocating motion of the crosshead; a pump chamber having an inner pressure which changes with the reciprocating motion of the plunger; an intake valve which connects a common intake line and the pump chamber, the intake valve having a side of the pump chamber as a back pressure side; a discharge valve which connects the pump chamber and a common discharge line, the discharge valve having a side of the common discharge line as a back pressure side; and an inner pressure adjustment mechanism which can adjust the inner pressure of the pump chamber, wherein when a line pressure of the common discharge line at a single discharge step in which only one reciprocating pump, among the plurality of reciprocating pumps, and the discharges fluid to the common discharge line differs from the inner pressure of the pump chamber of the one reciprocating pump at a discharge step starting point angle determined corresponding to a cam angle of the cam mechanism with respect to the one reciprocating pump, the inner pressure adjustment mechanism adjusts the inner pressure of the pump chamber of the one reciprocating pump based on the pressure difference such that the inner pressure of the pump chamber reaches the line pressure at the discharge step starting point angle.

5. A method of controlling a non-pulsating pump, the non-pulsating pump comprising:

a drive mechanism having: a cam mechanism which converts a rotational motion of a drive motor into a reciprocating motion; and a plurality of crossheads which are reciprocated by the cam mechanism with a predetermined phase difference;

a plurality of reciprocating pumps, each having: a plunger which is connected to the crosshead and which reciprocates with the reciprocating motion of the crosshead; a pump chamber having an inner pressure which changes with the reciprocating motion of the plunger; an intake valve which connects a common intake line and the pump chamber, the intake valve having a side of the pump chamber as a back pressure side; and a discharge valve which connects the pump chamber and a common discharge line, the discharge valve having a side of the common discharge line as a back pressure side; and a stroke adjustment mechanism which adjusts an effective stroke length for the crosshead to reciprocate the plunger, the method comprising:

when a line pressure of the common discharge line at a single discharge step in which only one reciprocating pump among the plurality of reciprocating pumps discharges fluid to the common discharge line differs from the inner pressure of the pump chamber of the one reciprocating pump at a discharge step starting point angle determined corresponding to a cam angle of the cam mechanism with respect to the one reciprocating pump, adjusting the effective stroke length of the respective crosshead connected to the plunger of the one reciprocating pump based on the pressure difference such that the inner pressure of the pump chamber reaches the line pressure at the discharge step starting point angle.

6. A method of controlling a non-pulsating pump, the non-pulsating pump comprising:

a drive mechanism having: a cam mechanism which converts a rotational motion of a drive motor into a reciprocating motion; and a plurality of crossheads which are reciprocated by the cam mechanism with a predetermined phase difference; and a plurality of reciprocating pumps, each having: a plunger which is connected to the crosshead and which reciprocates with the reciprocating motion of the crosshead; a pump chamber having an inner pressure which changes with the reciprocating motion of the plunger; an intake valve which connects a common intake line and the pump chamber, the intake valve having a side of the pump chamber as a back pressure side; a discharge valve which connects the pump chamber and a common discharge line, the discharge valve having a side of the common discharge line as a back pressure side; and an inner pressure adjustment mechanism which can adjust the inner pressure of the pump chamber, the method comprising:

when a line pressure of the common discharge line at a single discharge step in which only one reciprocating pump among the plurality of reciprocating pumps discharges fluid to the common discharge line differs from the inner pressure of the pump chamber of the one reciprocating pump at a discharge step starting point angle determined corresponding to a cam angle of the cam mechanism with respect to the one reciprocating pump, adjusting the inner pressure of the pump chamber of the one reciprocating pump based on the pressure difference such that the inner pressure of the pump chamber reaches the line pressure at the discharge step starting point angle.

* * * * *